US007392773B2

(12) United States Patent
Tashiro et al.

(10) Patent No.: US 7,392,773 B2
(45) Date of Patent: Jul. 1, 2008

(54) LIFT-VARIABLE VALVE-OPERATING SYSTEM FOR INTERNAL COMBUSTION ENGINE

(75) Inventors: Masahiko Tashiro, Wako (JP); Akiyuki Yonekawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/808,722

(22) Filed: Jun. 12, 2007

(65) Prior Publication Data

US 2007/0240654 A1 Oct. 18, 2007

Related U.S. Application Data

(62) Division of application No. 11/499,872, filed on Aug. 7, 2006.

(30) Foreign Application Priority Data

| | | | |
|---|---|---|---|
| Aug. 15, 2005 | (JP) | ..... | 2005-235190 |
| Jul. 19, 2006 | (JP) | ..... | 2006-197252 |
| Jul. 19, 2006 | (JP) | ..... | 2006-197253 |
| Jul. 19, 2006 | (JP) | ..... | 2006-197254 |

(51) Int. Cl.
*F01L 1/34* (2006.01)

(52) U.S. Cl. ..... 123/90.16; 123/90.39; 123/90.15

(58) Field of Classification Search ..... 123/90.15, 123/90.16, 90.2, 90.27, 90.39
See application file for complete search history.

(56) References Cited

U.S. PATENT DOCUMENTS 6,907,852 B2 * 6/2005 Schleusener et al. ..... 123/90.16

(Continued)

FOREIGN PATENT DOCUMENTS

DE 102 37 104 2/2004

(Continued)

OTHER PUBLICATIONS (4) European Search Reports dated Nov. 2, 2007 through Nov. 5, 2007.

*Primary Examiner*—Zelalem Eshete
(74) *Attorney, Agent, or Firm*—Kratz, Quintos & Hanson, LLP

(57) ABSTRACT

A lift-variable valve-operating system for an internal combustion engine, comprising: subsidiary cams which are swingably supported on a movable support shaft capable of being displaced within a plane perpendicular to a rotational axis of a valve-operating cam, and which are swung following the valve-operating cam; and rocker arms each operatively connected to an engine valve and operated following the subsidiary cams, operating characteristics including a lift amount of the engine valve being changed by displacing the movable support shaft, wherein the system further includes a control arm carried in an engine body to be capable of turning about a turning axis parallel to a rotational axis of the valve-operating cam, wherein the movable support shaft having an axis parallel to the turning axis of the control arm is retained on the control arm at a location offset from the turning axis, wherein a hydraulic tappet is mounted in the control arm to support one end of each of the rocker arms, and wherein a valve abutment portion provided at the other end of each of the rocker arms is in abutment against an upper end of a stem of the engine valve. Thus, it is possible to enhance the control accuracy in a state in which the lift amount of the engine valve is controlled to be low.

9 Claims, 21 Drawing Sheets

U.S. PATENT DOCUMENTS

| | | | | |
|---|---|---|---|---|
| 2002/0053326 | A1 | 5/2002 | Seitz et al. | |
| 2004/0261737 | A1 | 12/2004 | Rohe et al. | 123/90.16 |

FOREIGN PATENT DOCUMENTS

| | | | |
|---|---|---|---|
| DE | 102 37 104 | A1 | 2/2004 |
| EP | 0 442 460 | A1 | 8/1991 |
| EP | 0 521 412 | A1 | 1/1993 |
| JP | 59-201913 | | 11/1984 |
| JP | 2004-521234 | | 7/2004 |
| JP | 2004-353650 | | 12/2004 |
| WO | WO 2004/009967 | A1 | 1/2004 |
| WO | WO 2005/061864 | A1 | 7/2005 |

* cited by examiner

HIGH-LIFT

LOW-LIFT

HIGH-LIFT

LOW-LIFT

LIFT-VARIABLE VALVE-OPERATING SYSTEM FOR INTERNAL COMBUSTION ENGINE

RELATED APPLICATION

This application is a division of U.S. patent application Ser. No. 11/499,872, filed Aug. 7, 2006, and claims priority under 35 U.S.C. § 119 of Japanese Application No. 2006-197253, filed Jul. 19, 2006, which are incorporated in their entirety herein by reference.

BACKGROUND OF THE INVENTION

1. Field of the Invention

The present invention relates to a lift-variable valve-operating system for an internal combustion engine, comprising: subsidiary cams which are swingably supported on a movable Support shaft capable of being displaced within a plane perpendicular to a rotational axis of a valve-operating cam, and which are swung following the valve-operating cam; and rocker arms each operatively connected to an engine valve and operated following the subsidiary cams, operating characteristics including a lift amount of the engine valve being changed by displacing the movable support shaft.

2. Description of the Related Art

Published Japanese Translation No. 2004-521234 of PCT Application No. PCT/EP2002/004332 and German Patent Application Laid-open No. 10237104 disclose lift-variable valve-operating systems, in which rocker arms operatively connected to engine valves are swung by subsidiary cams swung by valve-operating cams, and the lift amount of the engine valves and the timing for opening and closing the engine valves are changed by displacing fulcrums of the subsidiary cams.

However, in the systems disclosed in the above publications, each of the rocker arms is swingably supported at one end thereof by a hydraulic tappet mounted in a cylinder head, but the subsidiary cams are supported by a member different from the cylinder head, leading to a possibility that the position of abutment of the subsidiary cam against the rocker arm may be changed due to a thermal influence even under the same operating conditions. The position of abutment of the subsidiary cam against the rocker arm may be also changed due to an assembling error and a cumulative dimensional error caused by the interposition of a plurality of different members between a swinging fulcrum for the rocker arm and a swinging fulcrum for the subsidiary cam. Thus, in a valve-operating system designed to change the lift amount of an engine valve, there is a possibility that, particularly in a low-lift state, the proportion of the change in the abutment position with respect to the lift amount may be increased to exert a significant influence to the control of the lift amount.

SUMMARY OF THE INVENTION

Accordingly, it is an object of the present invention to provide a lift-variable valve-operating system for an internal combustion engine, wherein the control accuracy is enhanced in a state in which the lift amount of the engine valve is controlled to be low.

In order to achieve the above object, according to a first feature of the present invention, there is provided a lift-variable valve-operating system for an internal combustion engine, comprising: subsidiary cams which are swingably supported on a movable support shaft capable of being displaced within a plane perpendicular to a rotational axis of a valve-operating cam, and which are swung following the valve-operating cam; and rocker arms each operatively connected to an engine valve and operated following the subsidiary cams, operating characteristics including a lift amount of the engine valve being changed by displacing the movable support shaft, wherein the system further includes a control arm carried in an engine body to be capable of turning about a turning axis parallel to a rotational axis of the valve-operating cam, wherein the movable support shaft having an axis parallel to the turning axis of the control arm is retained on the control arm at a location offset from the turning axis, wherein a hydraulic tappet is mounted in the control arm to support one end of each of the rocker arms, and wherein a valve abutment portion provided at the other end of each of the rocker arms is in abutment against an upper end of a stem of the engine valve.

With the arrangement of the first feature, the movable support shaft having the subsidiary cams swingably carried thereon is retained on the control arm, and the hydraulic tappet is mounted in the control arm to support one end of each of the rocker arms. Therefore, the assembling error and the cumulative dimensional error generated between the swinging fulcrum for the rocker arms and the swinging fulcrum for the subsidiary cams can be suppressed to be small, and even if there is a change in size due to the thermal expansion, the change in position of abutment of the subsidiary cam against the rocker arm can be suppressed to be small, thereby enhancing the control accuracy in a state in which the lift amount of the engine valve is controlled to be low.

According to a second feature of the present invention, in addition to the first feature, the turning axis of the control arm is disposed above the stem of the engine valve; and the valve abutment portion is formed to extend along an arc about the turning axis when the engine valve is in a closed state. With this arrangement, even if the control arm is turned about the turning axis, the abutment of the valve abutment member provided at the other end of the rocker arm against the stem can be maintained in such a manner that no large change in load is caused between the valve abutment member and the stem of the engine valve. Moreover, it is possible to reduce the wear generated at contact portions of the valve abutment member and the stem due to the turning of the control arm.

According to a third feature of the present invention, in addition to the second feature, the turning axis of the control arm is disposed within a width of the stem extended upward and projected onto a plane perpendicular to the turning axis of the control arm. With this arrangement, the turning axis of the control arm can be disposed at a location closer to the axis of the stem of the engine valve, thereby downsizing the valve-operating system.

According to a fourth feature of the present invention, in addition to any of the first to third features, the control arm has a pair of sidewalls spaced apart from each other along the turning axis, and a pair of shaft portions which protrude from outer surfaces of the sidewalls having the turning axis as their axes and which are turnably carried in the engine body; a driven member is mounted on the control arm and disposed centrally between both the sidewalls so that it is driven by a drive means for turnably driving the control arm; and the rocker arms are disposed between the driven member and both the sidewalls, respectively, so that they are partially overlapped on the driven member and the sidewalls, when viewed from a side. With this arrangement, the driven member and the sidewalls prevent the falling of the rocker arms each supported at one end by the hydraulic tappet, thereby facilitating the assembling of the rocker arms to the control arm, and further facilitating the assembling of the subsidiary cams to the control arm.

According to a fifth feature of the present invention, in addition to the fourth feature, the control arm has a connecting wall which integrally connects the sidewalls to each other; and the tappet supporting the one end of each of the rocker arms is mounted in the connecting wall. With such arrangement, the hydraulic tappets can be disposed, while enhancing the connection rigidity of the pair of sidewalls of the control arm.

According to a sixth feature of the present invention, in addition to the fifth feature, a cam abutment member is mounted on a subsidiary cam connection which integrally connects the pair of subsidiary cams to each other; and a lost motion spring for exhibiting a spring force for urging the subsidiary cam connection in a direction to bring the subsidiary cam connection into contact with the valve-operating cam is mounted between the connecting wall and the subsidiary cam connection, with its central portion disposed within a plane which is perpendicular to the rotational axis of the valve-operating cam and which passes through a widthwise central portion of the cam abutment member. With this arrangement, by disposing the lost motion spring in correspondence to a point of application of a load from the valve-operating cam to the subsidiary cam, the spring load of the lost motion spring can be set at a relatively small value, which contributes to downsizing of the lost motion spring and further to downsizing of the valve-operating system.

The above object, other objects, features and advantages of the invention will become apparent from the preferred embodiments with reference to the accompanying drawings.

BRIEF DESCRIPTION OF THE DRAWINGS

FIGS. 1 to 5 show a first embodiment of the present invention, wherein

FIG. 1 is a vertical sectional side view of essential portions of an internal combustion engine;

FIG. 2 is a sectional view taken along a line 2-2 in FIG. 1;

FIG. 3 is a sectional view taken along a line 3-3 in FIG. 2 in a high valve-lift state;

FIG. 4 is an exploded perspective view of essential portions of a valve-operating system; and FIG. 5 is a sectional view similar to FIG. 3, but in a low valve-lift state.

FIGS. 6 to 9 show a second embodiment of the present invention, wherein

FIG. 6 is a sectional view similar to FIG. 2 but taken along a line 6-6 in FIG. 8;

FIG. 7 is an exploded perspective view of essential portions of a valve-operating system;

FIG. 8 is a sectional view taken along a line 8-8 in FIG. 6; and

FIG. 9 is a sectional view similar to FIG. 8 but in a low valve-lift state.

FIGS. 10 and 11 show a third embodiment of the present invention, wherein FIG. 10 is a sectional view similar to FIG. 3; and FIG. 11 is a perspective view of a drive means.

FIGS. 12 to 21 show a fourth embodiment of the present invention, wherein FIG. 12 is a vertical sectional side view of essential portions of an internal combustion engine;

FIG. 13 is a sectional view taken along a line 13-13 in FIG. 12;

FIG. 14 is a sectional view taken along a line 14-14 in FIG. 13 in a high valve-lift state;

FIG. 15 is a sectional view taken along a line 15-15 in FIG. 13 in a high valve-lift state;

FIG. 16 is a sectional view similar to FIG. 15, but in a low valve-lift state;

FIG. 17 is a perspective view of a lift-variable valve-operating mechanism taken from one direction;

FIG. 18 is a perspective view of the lift-variable valve-operating mechanism taken from the other direction;

FIG. 19 is a perspective view of a control arm taken from one direction;

FIG. 20 is a perspective view of the control arm taken from the other direction; and FIG. 21 is a view taken in the direction of Arrow 21 in FIGS. 19 and 20.

DETAILED DESCRIPTION OF EXEMPLARY EMBODIMENTS

Figure 1:
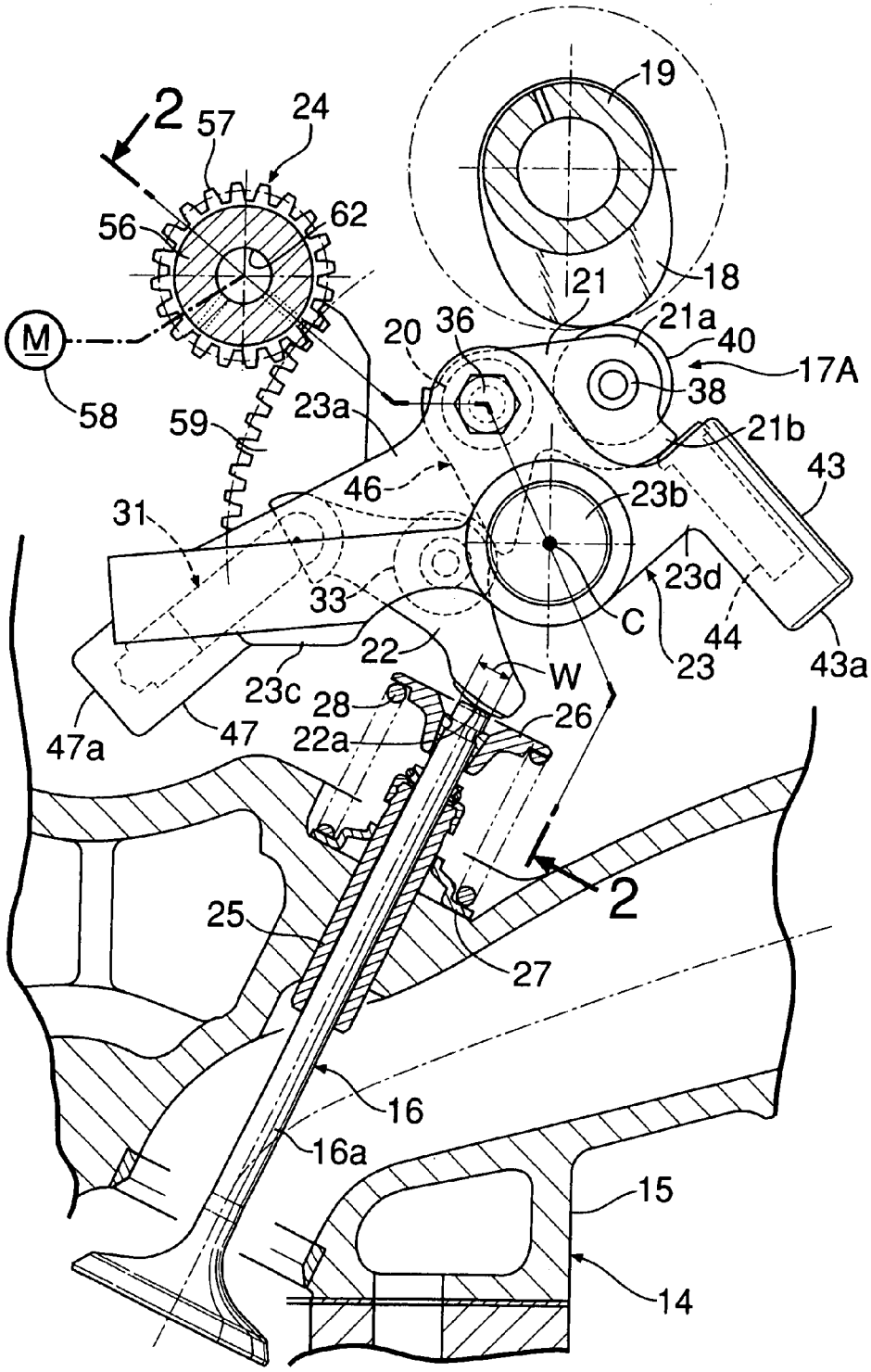
Figure 2:
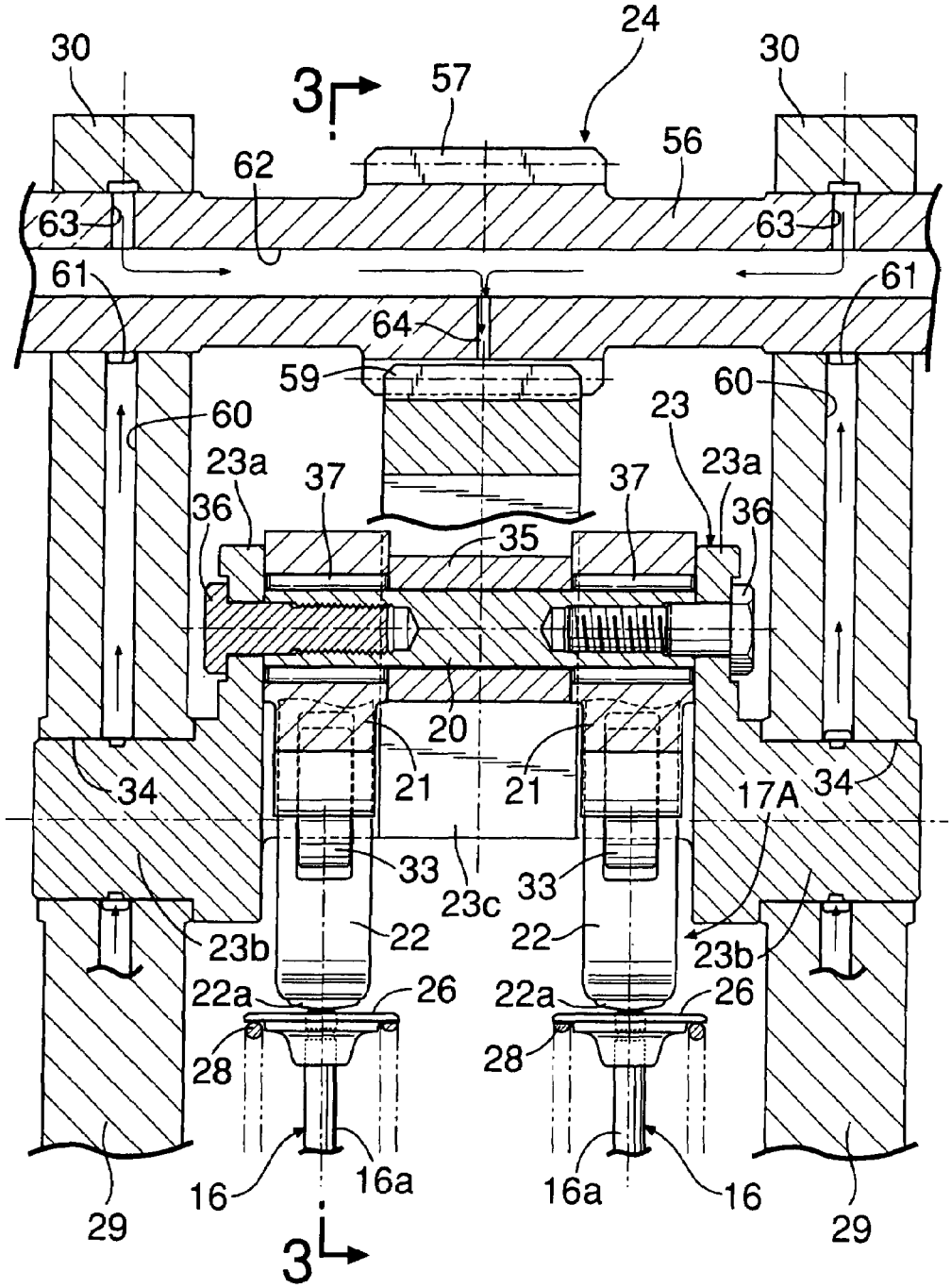

A first embodiment of the present invention will be described with reference to FIGS. 1 to 5. Referring first to FIGS. 1 to 4, intake valves 16 which are a pair of engine valves for each cylinder are openably and closably disposed in a cylinder head 15 constituting a portion of an engine body 14. A valve-operating device 17A for opening and closing the intake valves 16 includes: a camshaft 19 provided with valve-operating cams 18 individually corresponding to the intake valves 16; a pair of subsidiary cams 21, 21 which are swingably carried on a movable support shaft 20 displaceable in a plane perpendicular to rotational axes of the valve-operating cams 18, i.e., an axis of the camshaft 19, and which are swung following the valve-operating cams 18; a pair of rocker arms 22, 22 which are individually and operatively connected to the intake valves 16, respectively, and which are operated following the subsidiary cams 21; a control arm 23 which is connected to the movable support shaft 20 and capable of turning about an axis parallel to the axes of the valve-operating cams 18, i.e., to the axis of the camshaft 19, and which supports the movable support shaft 20 at a location offset from its rotational axis; and a drive means 24 for turnably driving the control arm 23. With this arrangement, the operational characteristics including a lift amount of the intake valves 16 can be changed by displacing the movable support shaft 20.

Stems 16*a*, 16*a* of the intake valves 16, 16 are slidably received in guide tubes 25, 25 disposed in the cylinder head 15. The intake valves 16, 16 are urged in a closing direction by valve springs 28, 28 interposed between retainers 26, 26 provided at upper ends of the stems 16*a*, 16*a* and retainers 27, 27 provided to abut against the cylinder head 15.

Cam holders 29, 29 are mounted in the cylinder head 15 so that they are disposed on opposite sides of the pair of intake valves 16. Caps 30, 30 adapted to rotatably carry the camshaft 19 by cooperation with the cam holders 29 are fastened to upper surfaces of the cam holders 29.

Each of the rocker arms 22, 22 is swingably carried at one end thereof on the control arm 23 through hydraulic tappets 31. Valve abutment portions 22*a*, 22*a* are provided at the other ends of the rocker arms 22 to abut against upper ends of the stems 16*a* of the intake valves 16. Further, first rollers 33 are carried at intermediate portions of the rocker arms 22 with needle bearings 32 interposed therebetween, so that the first rollers 33 are in rolling contact with the subsidiary cams 21 individually corresponding the rocker arms 22, respectively.

The control arm 23 integrally comprises: sidewalls 23*a*, 23*a* disposed on opposite sides of the intake valves 16 at a distance along the turning axis of the control arm 23; shaft portions 23*b*, 23*b* connected at right angles to outer surfaces of the sidewalls 23*a* in such a manner that an axis parallel to the camshaft 19 is a turning axis C; a first connecting wall 23*c* connecting one ends of the sidewalls 23*a* to each other; and a second connecting wall 23*d* connecting the other ends of the sidewalls 23*a* to each other. The shaft portions 23*b* are turnably fitted into support bores 34 provided in the cam holders 29. Namely, the control arm 23 is turnably carried on the cam holders 29.

The control arm 23 is formed into a shape of a square frame including the pair of sidewalls 23*a*, the first connecting wall 23*c*, and the second connecting wall 23*d*. Thus, the rigidity of the control arm 23 is enhanced by reinforcing effect of the first connecting wall 23*c* and the second connecting wall 23*d*. Particularly, the second connecting wall 23*d* is provided at a position in the vicinity of the shaft portions 23*b*, 23*b* on which a maximum load acts in the control arm 23, so as to effectively contribute to improvement of the rigidity of the control arm 23.

The turning axis C of the control arm 23, i.e., the axis of each of the shaft portions 23*b* is disposed above the stems 16*a* of the intake valves 16. The valve abutment portions 22*a* provided at the other ends of the rocker arms 22 are formed so that they extend along an arc A (indicated by a phantom line in FIG. 3) about the turning axis C of the control arm 23, when the intake valves 16 are in closed and seated states.

Moreover, the turning axis C of the control arm 23 is disposed within a width W (a width indicated by a dashed line in FIG. 1) of the stems 16*a* extended upward and projected onto a plane perpendicular to the turning axis C of the control arm 23.

The movable support shaft 20 having the axis parallel to the camshaft 19 extends through both the subsidiary cams 21 disposed inside the sidewalls 23*a* of the control arm 23 and through a cylindrical spacer 35 interposed between both the subsidiary cams 21, so that opposite ends of the movable support shaft 20 are in abutment against inner surfaces of the sidewalls 23*a*. Bolts 36, 36 inserted respectively through the sidewalls 23*a* are threadedly engaged with the opposite ends of the movable support shaft 20. Needle bearings 37, 37 are interposed between the movable support shaft 20 and both the subsidiary cams 21, respectively.

Thus, both the subsidiary cams 21 are turnably carried by the movable support shaft 20 detachably attached at its opposite ends to the sidewalls 29*a* of the control arm 23, and moreover the spacer 35 separate from the movable support shaft 20 is fitted over an outer periphery of the movable support shaft 20 in such a manner that it is interposed between the subsidiary cams 21, 21.

Furthermore, a pair of support arm portions 21*a* formed into a substantially U-shape opened toward the camshaft 19 and extending below the camshaft 19 is integrally connected to portions of the subsidiary cams 21 corresponding to between the shaft portions 23*b* of the control arm 23 and the movable support shaft 20. Second rollers 40 are carried on support shafts 38 fixed between tip ends of the support arm portions 21*a* with needle bearings 39 interposed therebetween, so that the second rollers 40 are in rolling contact with the valve-operating cams 18 of the camshaft 19, respectively. Thus, the subsidiary cams 21, 21 are turnably driven about the axis of the movable support shaft 20 by virtue of the second roller 40 being in contact with the valve-operating cams 18 of the camshaft 19.

Pressure-receiving arm portions 21*b*, 21*b* are integrally provided on the subsidiary cams 21, 21, respectively, on the side of the support shafts 38 opposite from the camshaft 19. Spring forces for urging the subsidiary cams 21 in a direction to bring the second rollers 40 into rolling contact with the valve-operating cams 18, respectively, are applied to the pressure-receiving arm portions 21*b*.

More specifically, bottomed cylindrical guide tubes 43, 43 are integrally provided on the second connecting wall 23*d* of the control arm 23 while individually corresponding to the subsidiary cams 21. The guide tubes 43, 43 have end walls 43*a* at ends opposite from the subsidiary cams 21, and extend to the side opposite from the subsidiary cams 21. Lost motion springs 45 are mounted under compression between the end walls 43*a* of the guide tubes 43 and abutment pieces 44 abutting against the pressure-receiving arm portions 21*b* of the subsidiary cams 21.

Abutment faces 46 are provided on lower surfaces of the subsidiary cams 21, so that the first rollers 33 of the rocker arms 22 are brought into rolling contact with the abutment faces 46. Each of the abutment faces 46 comprises: a lift portion 46*a* for turnably driving the rocker arm 22; and a base-circle portion 46*b* connected to the lift portion 46*a* and equidistant from the axis of the movable support shaft 20 to retain the rocker arm 22 in a stationary state. The lift portion 46*a* is formed to extend rectilinearly, so that the distance between a point of contact of the lift portion 46*a* with the first roller 33 of the rocker arm 22 and the axis of the movable support shaft 20 is gradually increased, when the subsidiary cam 21 is turned with the turning of the valve-operating cam 18.

The first connecting wall 23*c* of the control arm 23 is integrally provided, at its portion corresponding to the rocker arm 22, with bottomed cylindrical tappet-mounting tubular portions 47, which extend to the side opposite from the movable support shaft 20 and have end walls 47*a* at their ends opposite from the movable support shaft 20. The hydraulic tappets 31 are mounted in the tappet-mounting tubular portions 47.

The hydraulic tappet 31 includes: a bottomed cylindrical body 48 fitted and mounted within the tappet-mounting tubular portion 47 with its closed end abutting against the end wall 47*a*; a plunger 49 slidably mounted in the body 48; a check valve 52 which is mounted at one end of the plunger 49 and interposed between a high-pressure chamber 50 formed between the closed end of the body 48 and one end of the plunger 49, and an oil chamber 51 formed within the plunger 49; and a return spring 53 mounted between the body 48 and the plunger 49 to exhibit a spring force for urging the plunger 49 in a direction to increase the volume of the high-pressure chamber 50. The rocker arm 22 is swingably supported at one end thereof by a spherical head portion 49*a* formed at the other end of the plunger 49.

A hydraulic passage 54 for guiding a hydraulic pressure to the hydraulic tappets 31 is provided in the control arm 23 so as to reach the shaft portions 23*b*, whereby the hydraulic pressure is supplied from the cylinder head 15 through the shaft portions 23*b* to the hydraulic passage 54.

The drive means 24 includes: a drive shaft 56 which is rotatably carried between the cam holders 29 and the caps 30 and which has an axis parallel to the movable support shaft 20; a drive gear 57 provided on the drive shaft 56; and an electric motor 58 for rotatably driving the drive shaft 56, whereby the control arm 23 is rotatably driven about the axes of the shaft portions 23*c*, i.e., about the rotational axis C by the drive means 24.

The first connecting wall 23*c* of the control arm 23 is also provided with a sector gear 59 as a driven member disposed centrally between both the sidewalls 23*a*. The pair of rocker arms 22 are disposed between the sidewalls 23*a* of the control arm 23 and the sector gear 59, respectively, so that they are partially overlapped on the sector gear 59 and both the sidewalls 23*a*, when viewed from a side.

Annular recesses 61 are provided around inner peripheries of the cam holders 29 and the caps 30 at portions at which the drive shaft 56 is supported. The drive shaft 56 is provided with an oil passage 62 extending in one straight line, and communication bores 63 permitting the oil passage 62 to communicate with the annular recesses 61. The drive shaft 56 is further provided with an injection bore 64 for injecting the oil within the oil passage 62 toward meshed portions of the drive gear 57 and the sector gear 59, so that the oil injected from the injection bore 64 is used for the lubrication of the meshed portions of the drive gear 57 and the sector gear 59.

Figure 3:
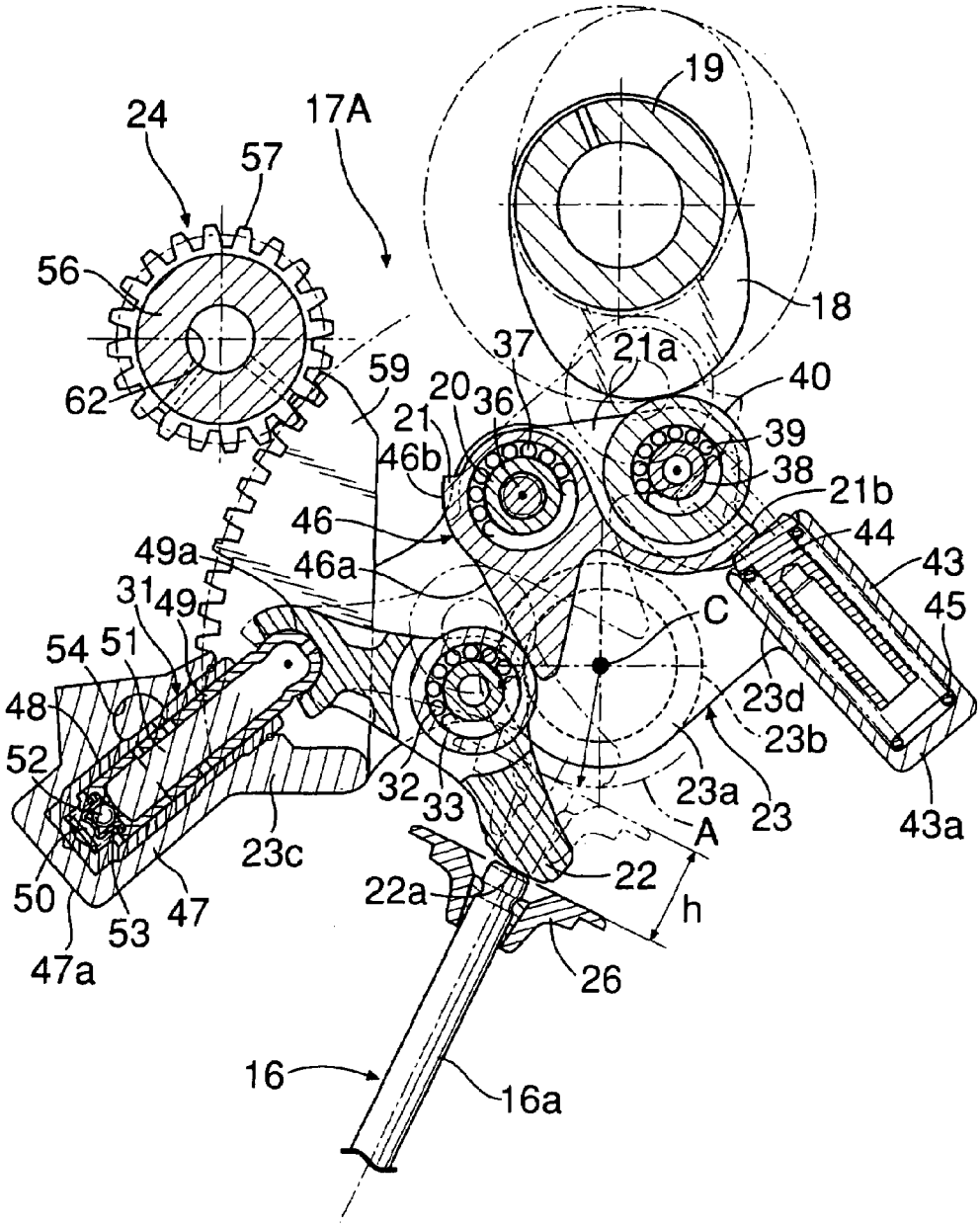
Figure 4:
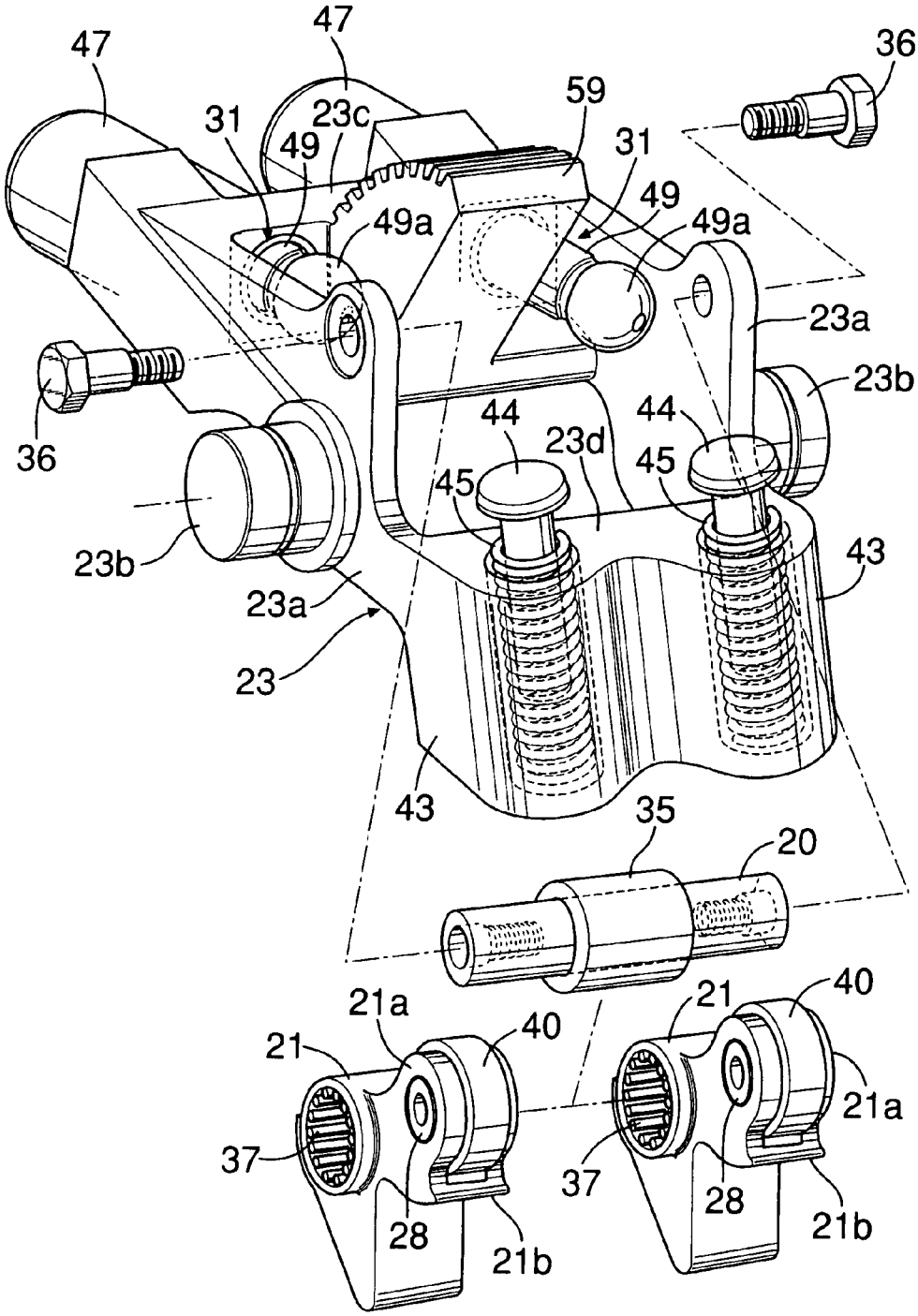
Figure 5:
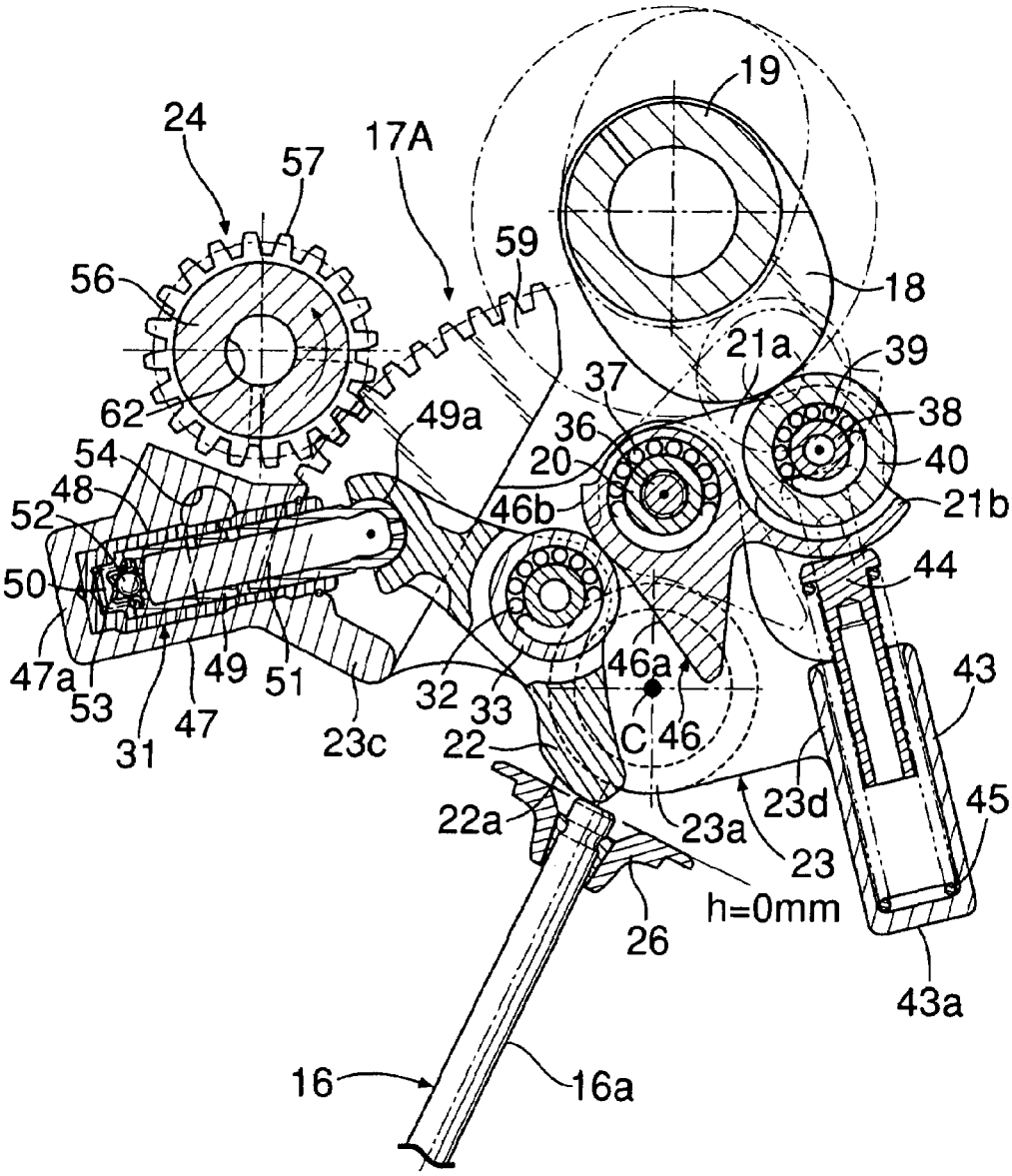
Figure 6:
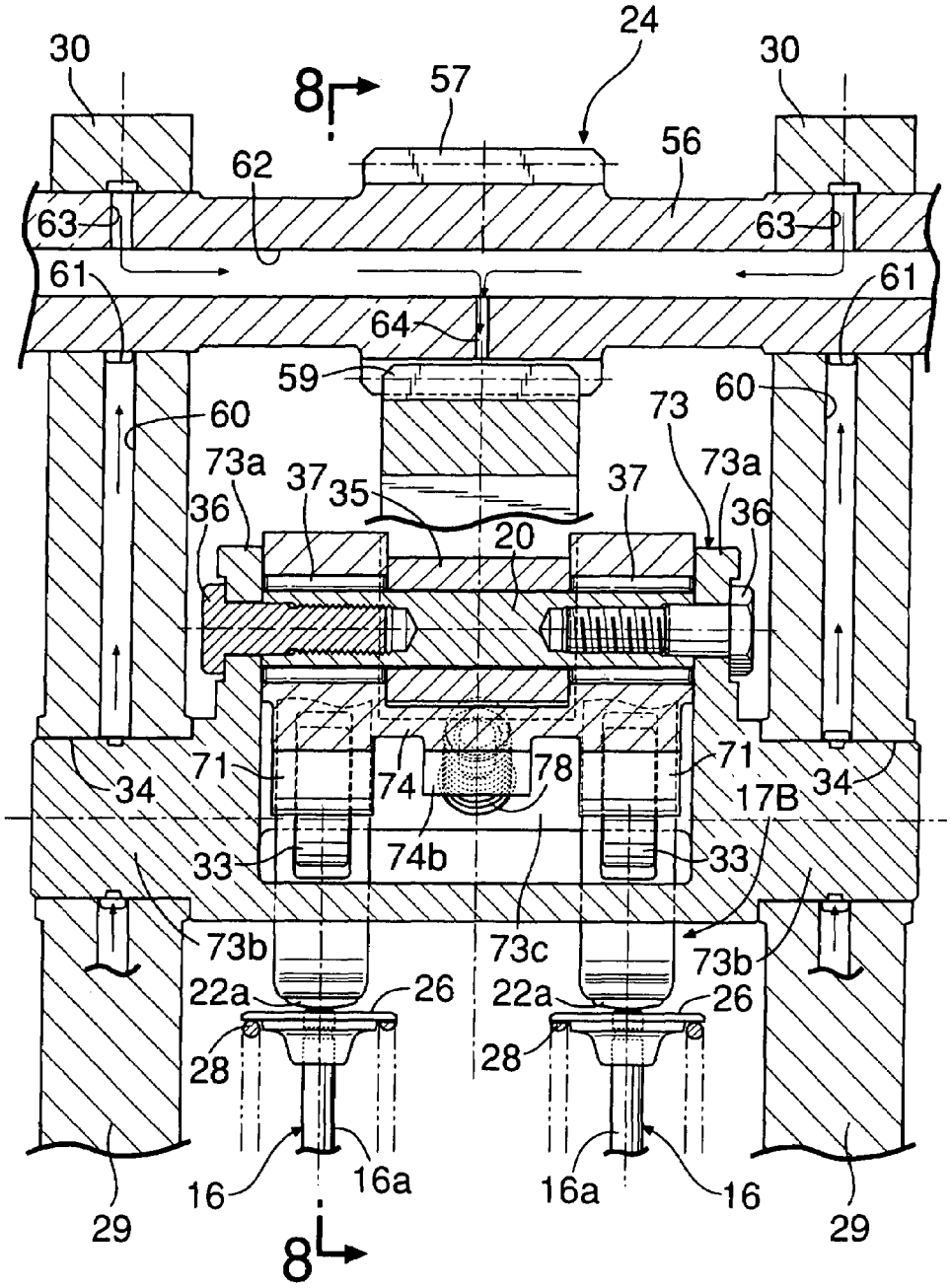
Figure 7:
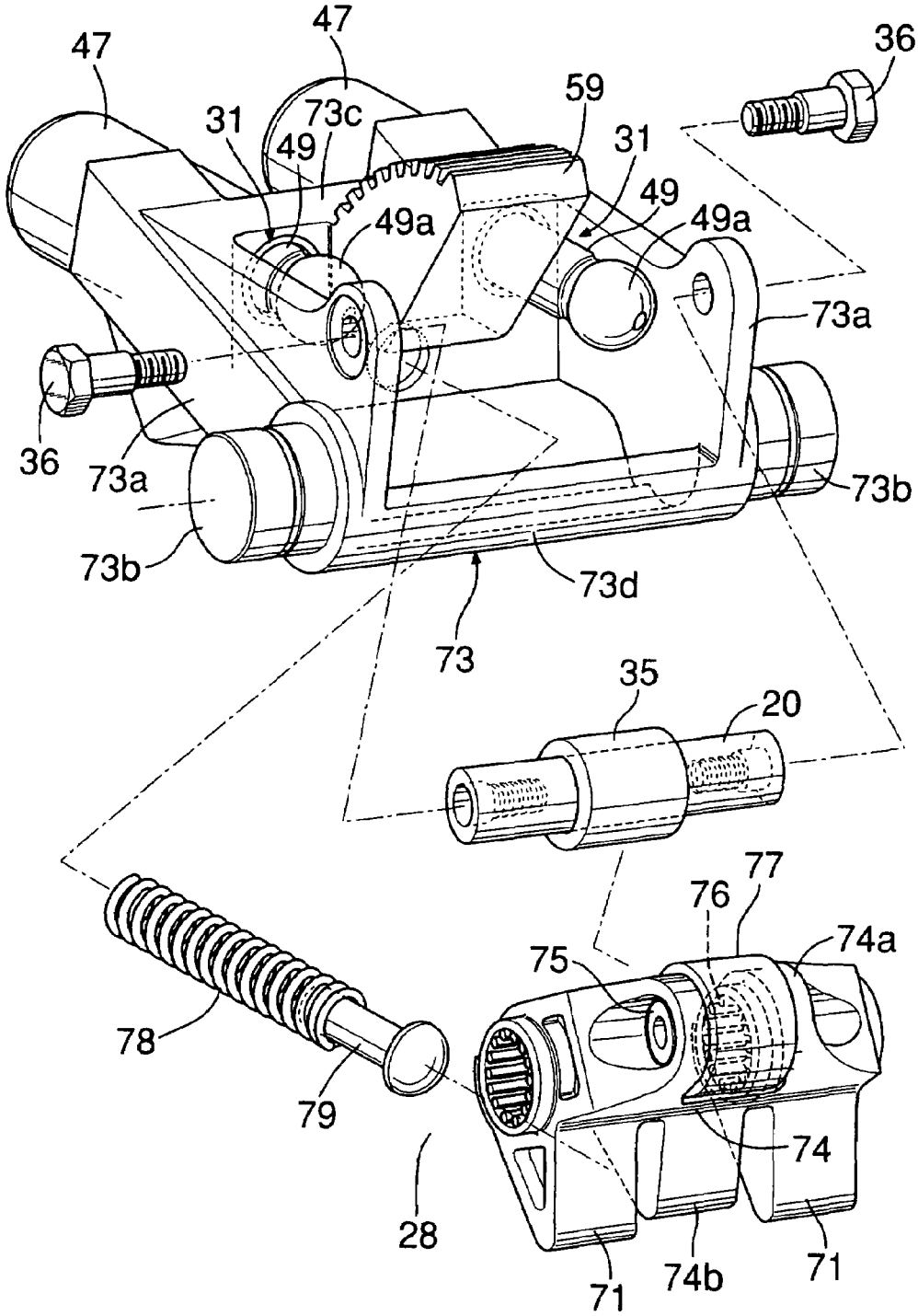

When the control arm 23 is disposed at the location shown in FIG. 3 by the drive means 24, the upper ends of the stems 16*a* of the intake valves 16 are driven in an opening direction by the ends of the lift portions 46*a*, opposite from the base-circle portions 46*b*, of the abutment faces 46 of the subsidiary cams 21 turned about the axis of the movable support shaft 20, and in this state, the lift amount h of the intake valves 16 is largest. When the control arm 23 is turned upward by the drive means 24, as shown in FIG. 5, for example, the upper ends of the stems 16*a* of the intake valves 16 are put into abutment against the base-circle portions 46*b* of the abutment faces 46 of the subsidiary cams 21, and in this state, the lift amount h of the intake valves 16 is smallest (=0).

In other words, the lift amount of the intake valves 16 is changed by turning the control arm 23 by the drive means 24, and the timing for opening and closing the intake valves 16 is also changed by changing the timing for bringing the valve-operating cams 18 into contact with the second rollers 40 by the turning of the control arm 23.

The operation of the first embodiment will be described below. The movable support shaft 20 having the axis parallel to the turning axis C of the control arm 23 is retained at the location offset from the turning axis C of the control arm 23 carried in the cylinder head 15 of the engine body 14 so as to turn about the turning axis parallel to the rotational axes of the valve-operating cams 18. The hydraulic tappets 31 each supporting one end of each of the rocker arms 22 are mounted in the control arm 23. The valve abutment portions 22*a* provided at the other ends of the rocker arms 22 are in abutment against the upper ends of the stems 16*a* of the intake valves 16.

Thus, because the movable support shaft 20 having the subsidiary cams 21 swingably carried thereon are retained on the control arm 23, and the hydraulic tappets 31 each supporting one end of each of the rocker arms 22 are mounted in the control arm 23, an assembling error and a cumulative dimensional error generated between a fulcrum for swinging of the rocker arms 22 and a fulcrum for swinging of the subsidiary cams 21 can be suppressed to a low level. Further, even if a change in dimension due to the thermal expansion or the like is caused, a change in positions of abutment of the subsidiary cams 21 against the rocker arms 22 can be suppressed to a low level, leading to an enhancement in control accuracy in a state in which the lift amount of the intake valves 16 is controlled to be low.

In addition, the turning axis C of the control arm 23 is disposed above the stems 16*a* of the intake valves 16, and the valve abutment portions 22*a* provided on the rocker arms 22 to abut against the upper ends of the stems 16*a* of the intake valves are formed so as to extend along the arc A about the turning axis C, when the intake valves 16 are in their closed states. Therefore, even if the control arm 23 is turned about the turning axis C, the abutment of the valve abutment portions 22*a* against the stems 16*a* can be maintained in such a manner that no large change in load is generated between the valve abutment portions 22*a* of the rocker arms 22 and the stems 16*a* of the intake valves 16. Moreover, it is possible to reduce the wear caused on the contact portions of the valve abutment portions 22*a* and the stems 16*a* with the turning of the control arm 23.

Further, the turning axis C of the control arm 23 is disposed within the width W of the stems 16*a* extended upward and projected onto the plane perpendicular to the turning axis C of the control arm 23. Therefore, the turning axis C of the control arm 23 can be provided at a location closer to the axes of the stems 16*a* of the intake valves 16, thereby downsizing the compactness of the valve-operating device 17A.

Further, the control arm 23 includes: the pair of sidewalls 23*a* spaced apart from each other along the turning axis C; and the pair of shaft portions 23*b* which protrude from outer surfaces of the sidewalls 23*a* having the turning axis C as their axes and which are turnably supported by the cam holders 29 in the cylinder head 15. The control arm 23 is provided with the sector gear 59 disposed centrally between both the sidewalls 23*a* in such a manner that it is driven by the drive means 24 for turnably driving the control arm 23. The rocker arms 22 are disposed between the sector gear 59 and the sidewalls 23*a* of the control arm 23, respectively, so that they are partially overlapped on the sector gear 59 and both the sidewalls 23*a*, when viewed from a side.

Therefore, it is possible to prevent the falling of the rocker arms 22 each supported at one end by the hydraulic tappets 31 by the sector gear 59 and the sidewalls 23*a*, thereby facilitating the assembling of the rocker arms 22 to the control arm 23, and further facilitating the assembling of the subsidiary cams 21 to the control arm 21.

Moreover, the control arm 23 has the first connecting wall 23*c* which integrally connects one ends of the sidewalls 23*a* to each other, and the hydraulic tappets 31 supporting the one ends of the rocker arms 22 are mounted on the first connecting wall 23*c*. Therefore, the hydraulic tappets 31 can be disposed, while enhancing the rigidity of connection of the pair of sidewalls 23*a* of the control arm 23.

Additionally, since the movable support shaft 20 having the subsidiary cams 21, 21 swingably carried thereon are detachably mounted to the control arm 23, the operation for attaching and detaching the subsidiary cams 21 can be carried out without removal of the other components such as the rocker arms 22, thereby facilitating operation of replacing parts.

Further, the spacer 35 separate from the movable support shaft 20 having the pair of subsidiary cams 21, 21 swingably carried thereon is fitted over the outer periphery of the movable support shaft 20 so that it is interposed between both the subsidiary cams 21, 21. Therefore, it is possible to define the positions of the subsidiary cams 21 in a direction along the axis of the movable support shaft 20, while simplifying the shape of the movable support shaft 20.

FIGS. 6 to 9 show a second embodiment of the present invention, wherein components corresponding to those in the first embodiment are only shown with the same reference numerals and symbols, and the detailed description of them is omitted.

A valve-operating device 17B for opening and closing the intake valves 16 includes: a camshaft 69 provided with a single valve-operating cam 68 common to both the intake valves 16; a pair of subsidiary cams 71, 71 which are swingably carried on a movable support shaft 20 capable of being displaced within a plane perpendicular to a rotational axis of the valve-operating cam 68, i.e., an axis of the camshaft 69, and which are swung following the valve-operating cam 68; a pair of rocker arms 22, 22 individually and operatively connected to the intake valves 16 and adapted to follow the subsidiary cams 71; a control arm 73 which is capable of being turned about an axis parallel to the axis of the valve-operating cam 68 and which supports the movable support shaft 20 at a location offset from its turning axis C; and a drive means 24 for turnably driving the control arm 73.

The rocker arms 22 are swingably supported at their one ends on the control arm 73 through hydraulic tappets 31. First rollers 33 supported at intermediate portions of the rocker arms 22 with needle bearings 32 interposed therebetween are in rolling contact with the subsidiary cams 71 individually corresponding to the rocker arms 22.

The control arm 73 integrally comprises: sidewalls 73*a*, 73*a* disposed on opposite sides of the intake valves 16 at a distance along the turning axis of the control arm 73; shaft portions 73*b*, 73*b* connected at right angles to outer surfaces of the sidewalls 73*a* in such a manner that an axis parallel to the camshaft 19 is the turning axis C; a first connecting wall 73*c* connecting one ends of the sidewalls 73*a* to each other; and a second connecting wall 73*d* connecting the other ends of the sidewalls 73*a* to each other. The shaft portions 73*b* are turnably fitted into support bores 34 in cam holders 29.

The turning axis C of the control arm 73, i.e., the axis of each of the shaft portions 73*b* is disposed above the stems 16*a* of the intake valves 16, and moreover the turning axis C of the control arm 73 is disposed within a width W (a width indicated by a dashed line in FIG. 8) of the stems 16*a* extended upward and projected onto a plane perpendicular to the turning axis C of the control arm 73.

The movable support shaft 20 having the axis parallel to the camshaft 19 extends through both the subsidiary cams 71 disposed inside the sidewalls 73*a* of the control arm 73 and through a cylindrical spacer 35 interposed between both the subsidiary cams 71, so that opposite ends of the movable support shaft 20 are in abutment against inner surfaces of the sidewalls 73*a*. Bolts 36, 36 inserted respectively through the sidewalls 73*a* are threadedly engaged with the opposite ends of the movable support shaft 20, and needle bearings 37, 37 are interposed between the movable support shaft 20 and both the subsidiary cams 71, respectively.

Moreover, the subsidiary cams 71 are integrally connected to each other by a subsidiary cam connection 74, and a roller 77, which is a cam abutment member, is supported through a needle bearing 76 on a support shaft 75 fixed to a substantially U-shaped support portion 74*a* provided on the subsidiary cam connection 74, so that the roller 77 is in rolling contact with the valve-operating cam 68 of the camshaft 69. That is, the pair of subsidiary cams 71 are turnably driven about the axis of the movable support shaft 20 by virtue of the roller 77 being in contact with the valve-operating cam 68 of the camshaft 69.

The subsidiary cam connection 74 is urged by a lost motion spring 78 in a direction to bring the roller 77 into contact with the valve-operating cam 68. The lost motion spring 78 is mounted between the first connecting wall 73*c* of the control arm 73 and the subsidiary cam connection 74, with its central portion disposed within a plane perpendicular to the rotational axis of the valve-operating cam 68 and passing through a widthwise central portion of the roller 77.

In other words, a pressure-receiving arm portion 71*b* is integrally provided on the subsidiary cam connection 74, and the lost motion spring 78 is mounted under compression between an abutment piece 79 abutting against the pressure-receiving arm portion 71*b* and the first connecting wall 73*c* of the control arm 73.

As in the first embodiment, an abutment face 46 is provided on a lower surface of each of the subsidiary cams 71 so that each of the first rollers 33 of the rocker arms 22 is in rolling contact with the abutment face 46. The abutment face 46 comprises a lift portion 46*a* adapted to turnably drive the rocker arm 22, and a base-circle portion 46*b* equidistant from the axis of the movable support shaft 20 so as to retain the rocker arm 22 in a stationary state, wherein the lift portion 56*a* and the base-circle portion 46*b* are connected to each other.

The first connecting wall 73*c* of the control arm 73 is integrally provided, at its portions corresponding to the rocker arms 22, with bottomed cylindrical tappet-mounting tubular portions 47 which extend to the side opposite from the movable support shaft 20 and which have end walls 47*a* at their ends opposite from the movable support shaft 20. The hydraulic tappets 31 are mounted in the tappet-mounting tubular portions 47.

The first connecting wall 73*c* of the control arm 73 is also provided with a sector gear 59, as a driven member driven by the drive means 24, disposed centrally between both the sidewalls 23*a*, and the pair of rocker arms 22 are disposed between the sidewalls 73*a* of the control arm 73 and the sector gear 59, respectively, so that they are partially overlapped on the sector gear 59 and both the sidewalls 73*a*, when viewed from a side.

Figure 8:
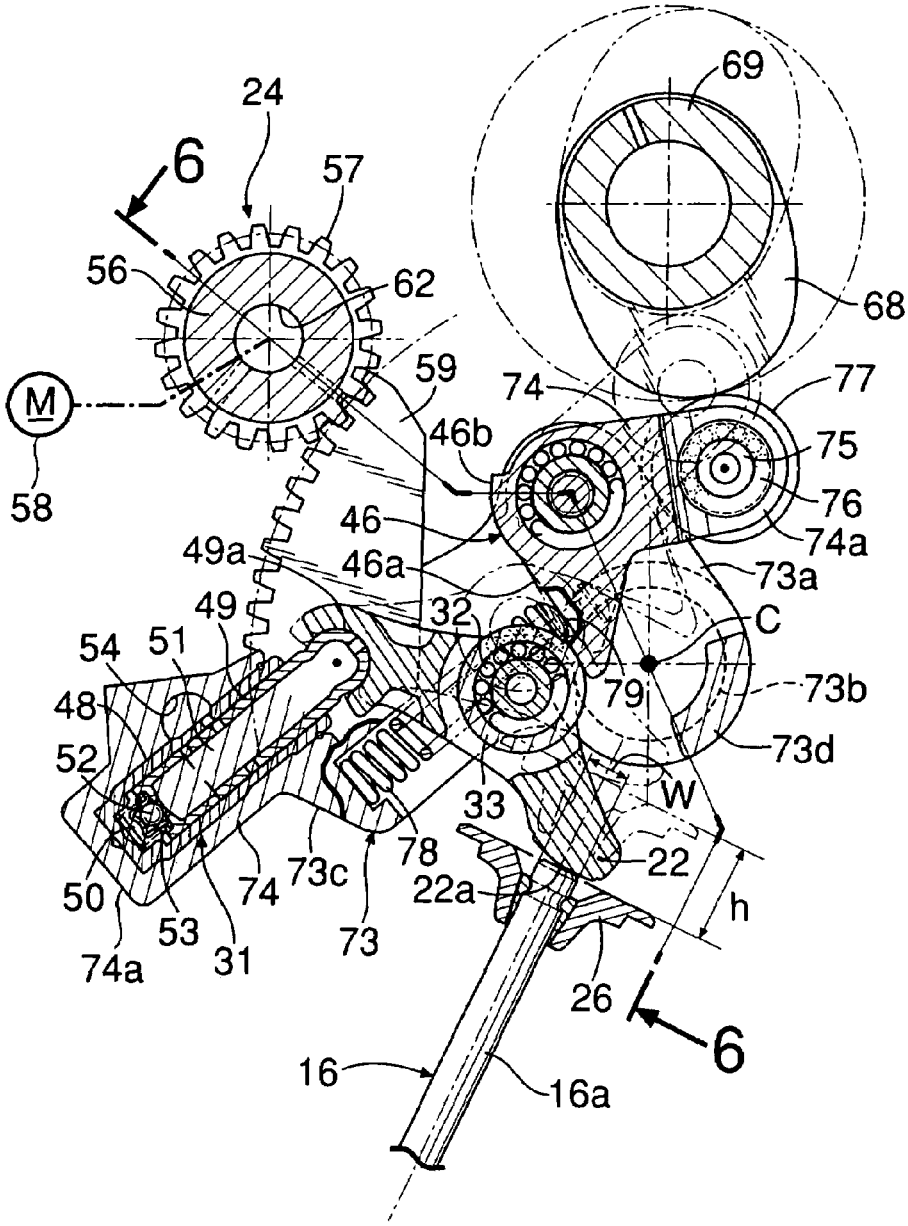
Figure 9:
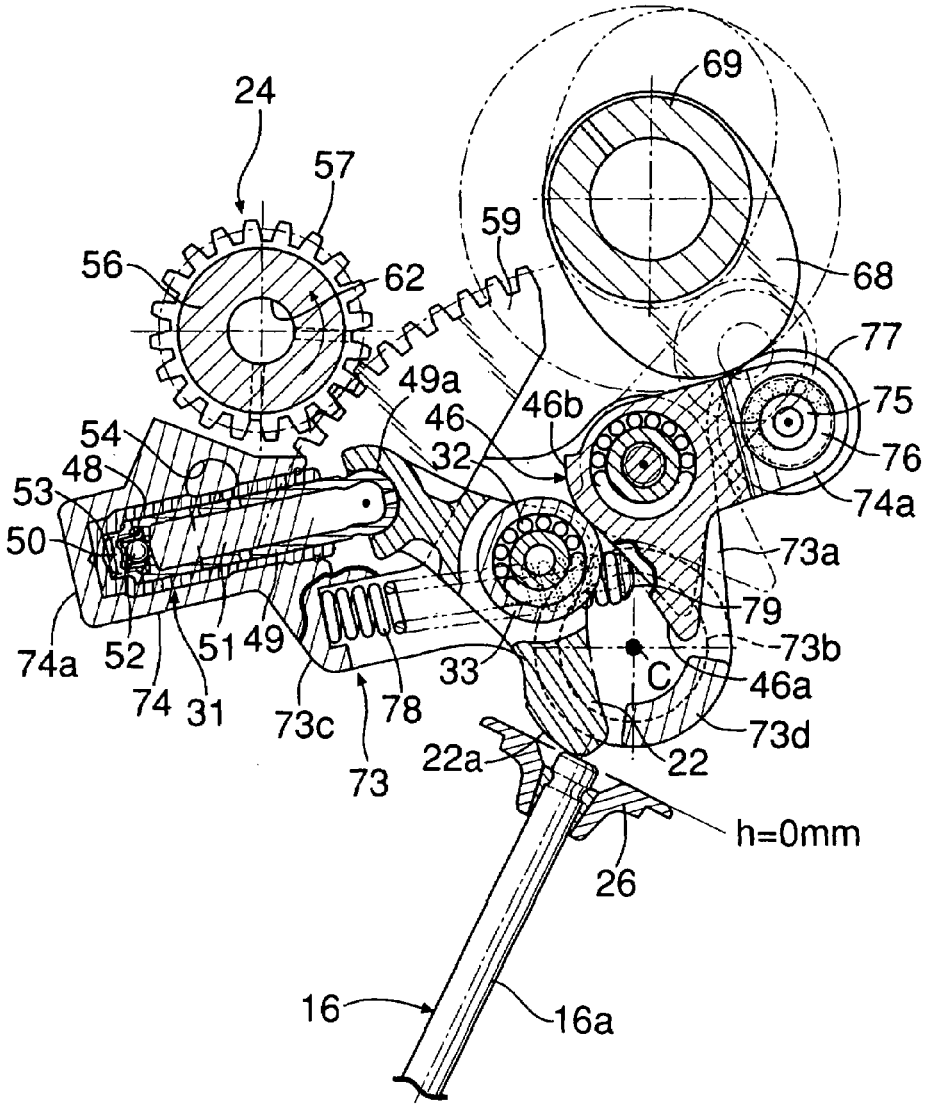

When the control arm 73 is disposed at a location shown in FIG. 8 by the drive means 24, the upper ends of the stems 16*a* of the intake valves 16 are driven in an opening direction by the ends of the lift portions 46*a*, opposite from the base-circle portions 46*b*, of the abutment faces 46 of the subsidiary cams 71 turned about the axis of the movable support shaft 20, and in this state, the lift amount h of the intake valves 16 is largest. When the control arm 73 is turned upward by the drive means 24, as shown in FIG. 9, for example, the upper ends of the stems 16*a* of the intake valves 16 are put into abutment against the base-circle portions 46*b* of the abutment faces 46 of the subsidiary cams 71, and in this state, the lift amount h of the intake valves 16 is smallest (=0).

In other words, the lift amount of the intake valves 16 is changed by turning the control arm 73 by the drive means 24, and the timing for opening and closing the intake valves 16 is also changed by changing the timing for bringing the valve-operating cams 68 into contact with the rollers 77 by the turning of the control arm 73.

According to the second embodiment, the effect same as that in the first embodiment can be provided. Moreover, the roller 77 abutting against the valve-operating cam 68 is supported on the subsidiary cam connection 74 integrally connecting the pair of subsidiary cams 71 to each other, and the lost motion spring 78 exhibiting the spring force for urging the subsidiary cam connection 74 in the direction to bring the roller 77 into contact with the valve-operating cam 68 is mounted between the first connecting wall 73*c* and the subsidiary cam connection 74, with its central portion disposed within the plane perpendicular to the rotational axis of the valve-operating cam 68 and passing through the widthwise central portion of the roller 77. Therefore, it is possible to set the spring load of the lost motion spring 78 at a relatively small value by disposing the lost motion spring 78 in correspondence to a point of application of a load from the valve-operating cam 68 to the subsidiary cams 71, which contributes to downsizing of the lost motion spring 78 and further to downsizing of the valve-operating device.

Figure 10:
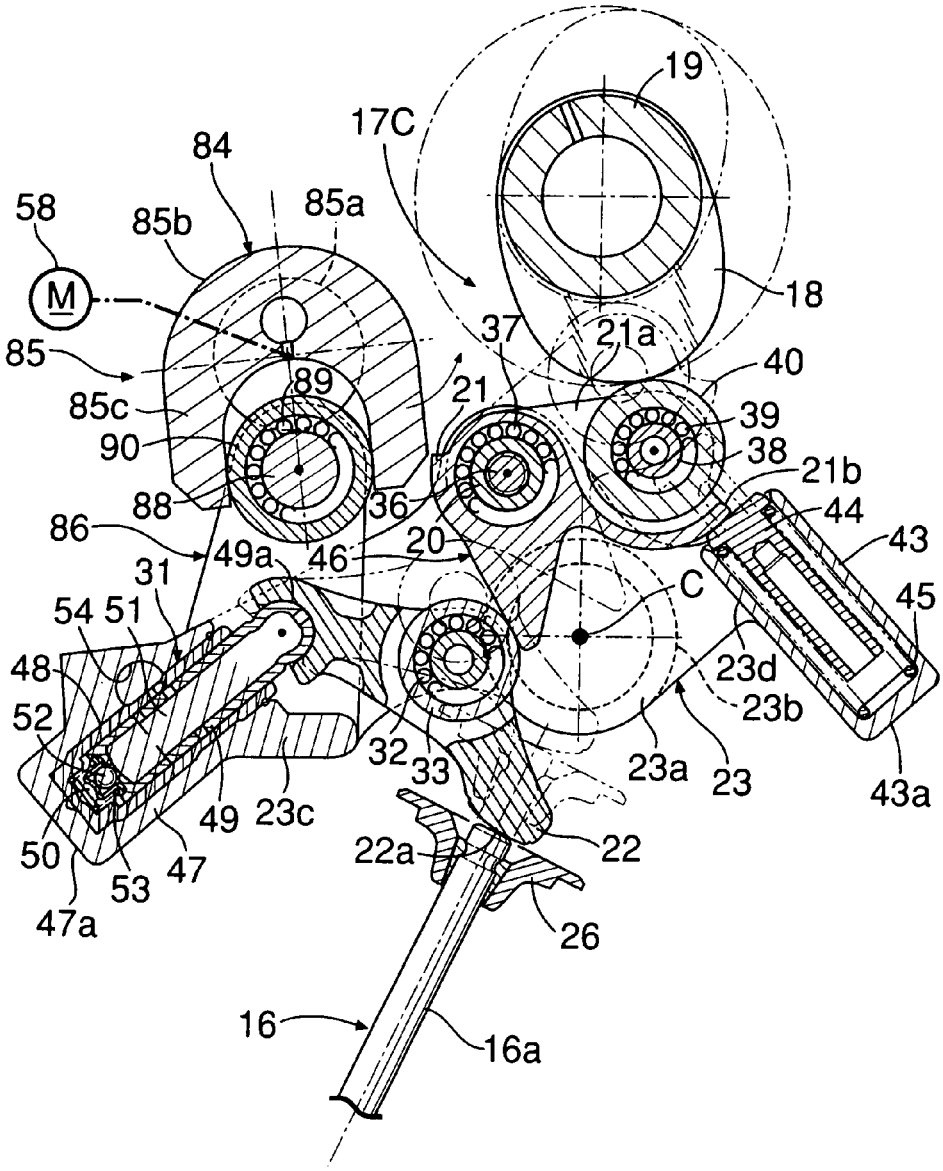
Figure 11:
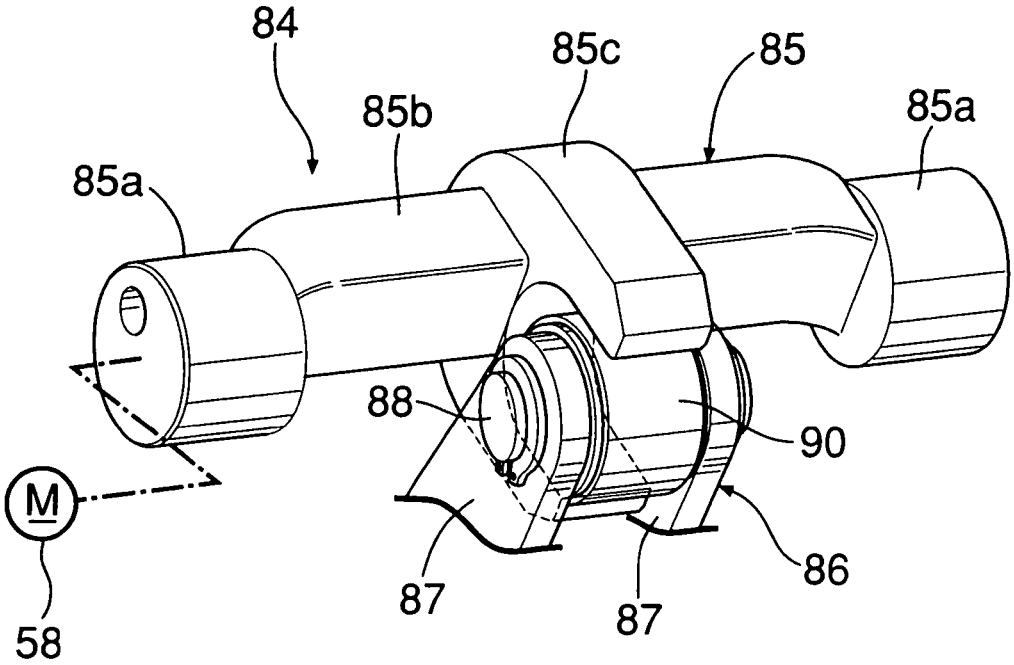

FIGS. 10 and 11 show a third embodiment of the present invention, wherein components corresponding to those in the first embodiment are only shown with the same reference numerals and symbols, and the detailed description of them is omitted.

A valve-operating device 17C for opening and closing a pair of intake valves 16 includes: a camshaft 19 provided with valve-operating cams 18 individually corresponding to both the intake valves 16; a pair of subsidiary cams 21 which are swingably carried on a movable support shaft 20 capable of being displaced within a plane perpendicular to axes of the valve-operating cams 18, i.e., an axis of the camshaft 19, and which are swung following the valve-operating cams 18; a pair of rocker arms 22, 22 individually and operatively connected to the intake valves 16 and adapted to follow the subsidiary cams 21, respectively; a control arm 23 which is capable of being turned about an axis parallel to the axes of the valve-operating cams 18, i.e., the axis of the camshaft 19 and which supports the movable support shaft 20 at a location offset from its turning axis; and a drive means 24 for turnably driving the control arm 23.

The drive means 84 includes a drive shaft 85 and an electric motor 58 connected to one of the shaft portions 85*a*. The drive shaft 85 integrally comprises: a pair of shaft portions 85*a*, 85*a* turnably carried between cam holders 29 and caps 30 as shown in the first embodiment; a connecting wall 85*b* connecting eccentric positions of the shaft portions 85*a* to each other; and a clamping portion 85*c* formed into a substantially U-shape and provided at a central portion of the connecting wall 85*b*. A drive portion 86 driven by the drive means 84 is provided on the first connecting wall 23*c* of the control arm 23, so that it is disposed centrally between both the sidewalls 23*a*.

The driven member 86 comprises a pair of support arms 87, 87 integrally provided on the first connecting wall 23*c* of the control arm 23 at an intermediate location between both the sidewalls 23*a* to extend upward, and a roller 90 supported on a support shaft 88 mounted between tip ends of the support arms 87 with a needle bearing 89 interposed therebetween. The roller 90 is clamped by the clamping portion 85*c* of the drive means 84.

Thus, the rocker arm 23 is turned about the turning axis C by turning the drive shaft 85 about axes of the shaft portions 85*a*, thereby changing operating characteristics including the lift amount of the intake valves 16.

The pair of rocker arms 22 are disposed between the sidewalls 23*a* of the control arm 23 and the driven member 88, respectively, so that they are partially overlapped on the driven member 88 and the sidewalls 23*a*, when viewed from a side.

Also according to the third embodiment, the effect same as that in the first embodiment can be provided.

A fourth embodiment of the present invention will be described with reference to FIGS. 12 to 21.

Figure 12:
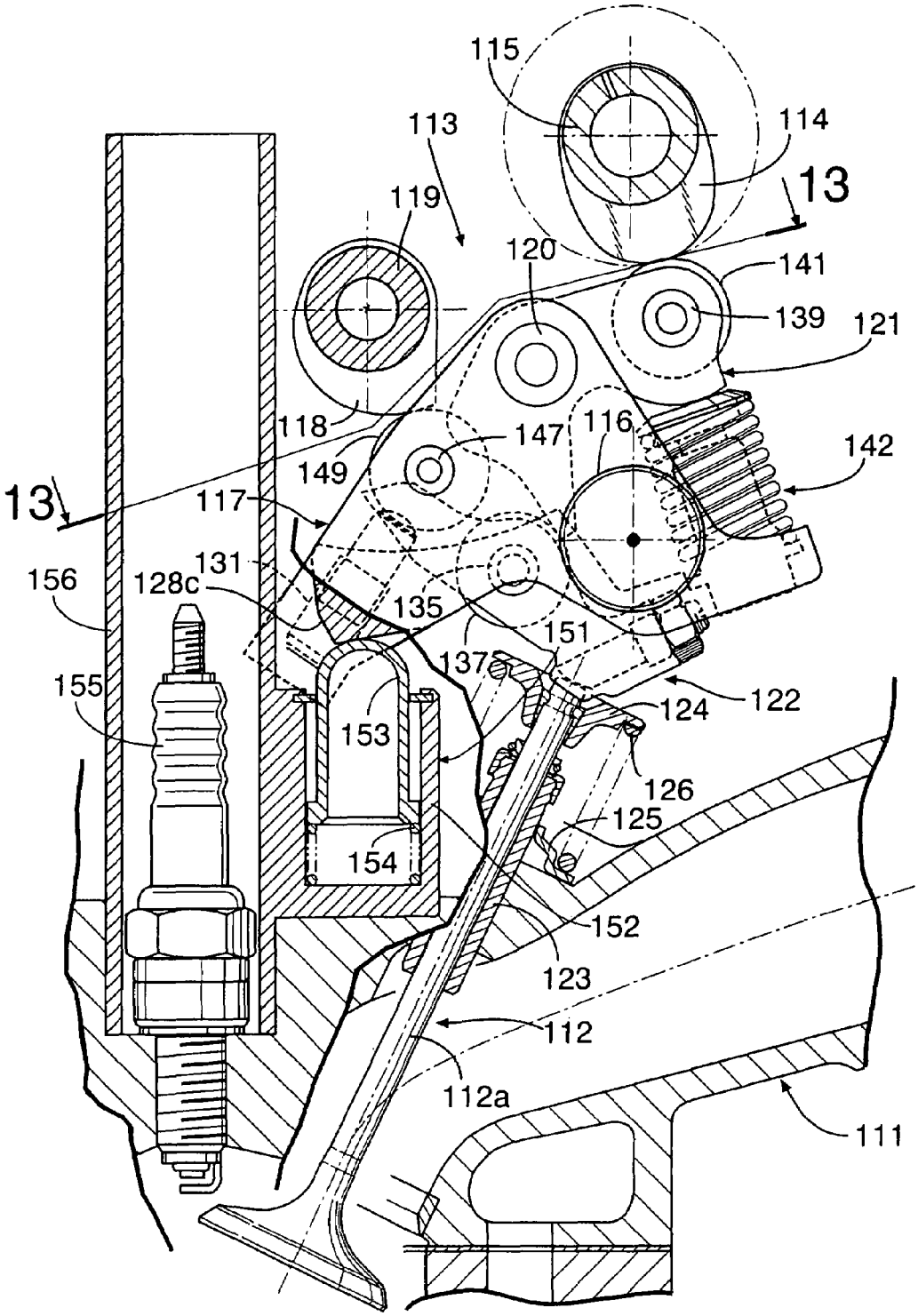
Figure 13:
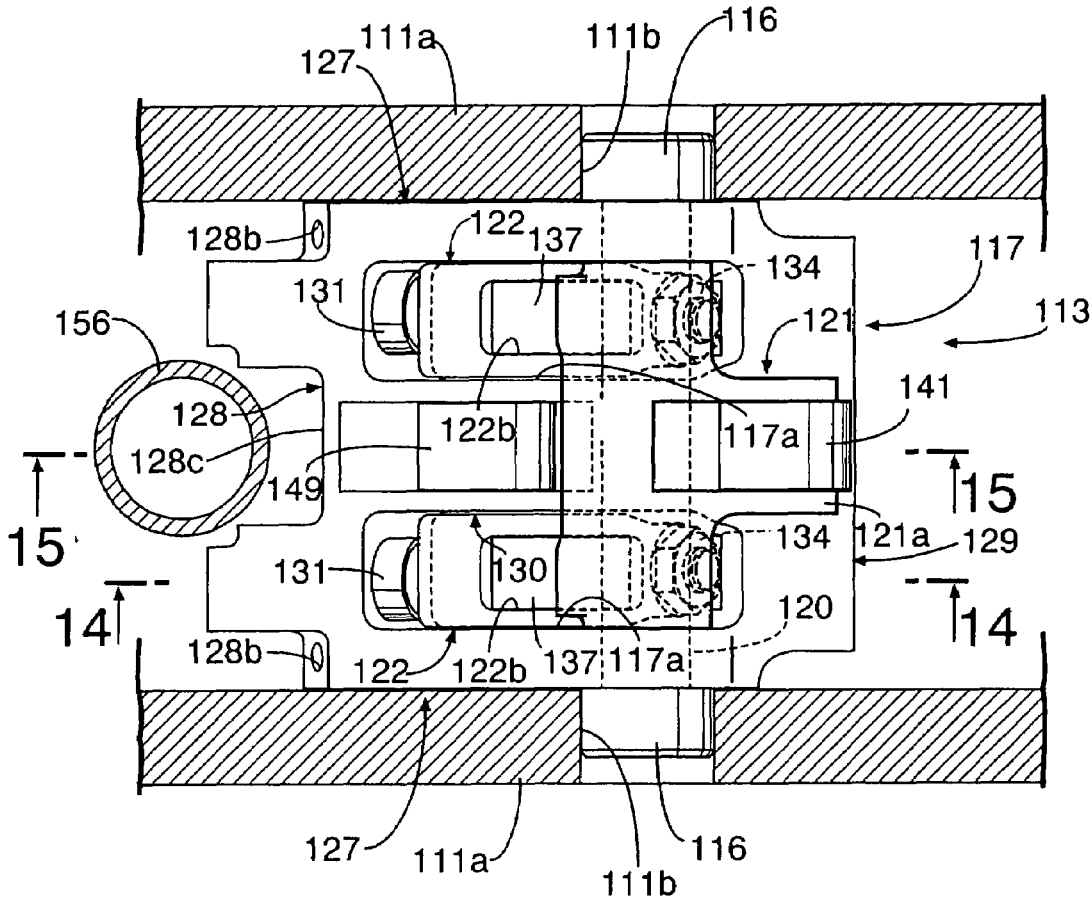

As shown in FIGS. 12 and 13, intake valves 112 which are a pair of engine valves for each cylinder are openably and closably disposed in a cylinder head 111 of an internal combustion engine. A lift-variable valve-operating mechanism 113 for opening and closing the intake valves 112 includes: a camshaft 115 provided with a valve-operating cam 114; a control arm 117 swingably supported via shaft portions 116, 116 in axis holes 111*b*, 111*b* of a pair of support walls 111*a*, 111*a* provided in the cylinder head 111; a control shaft 119 provided with a control cam 118 for swinging the control arm 117; a subsidiary cam 121 which is swingably supported via a movable support shaft 20 in the control arm 117, and which is swung following the valve-operating cam 114; a pair of rocker arms 122, 122 which are individually and operatively connected to the intake valves 112, 112, respectively, and which are operated following the subsidiary cam 121, respectively, whereby the operational characteristics including a lift amount of the intake valves 112 can be changed by displacing the movable support shaft 120.

Stems 112*a*, 112*a* of the intake valves 112, 112 are slidably received in guide tubes 123, 123 disposed in the cylinder head 111. The intake valves 112, 112 are urged in a closing direction by valve springs 126, 126 interposed between retainers 124, 124 provided at upper ends of the stems 112*a*, 112*a* and retainers 125, 125 abutting on the cylinder head 111.

Figure 19:
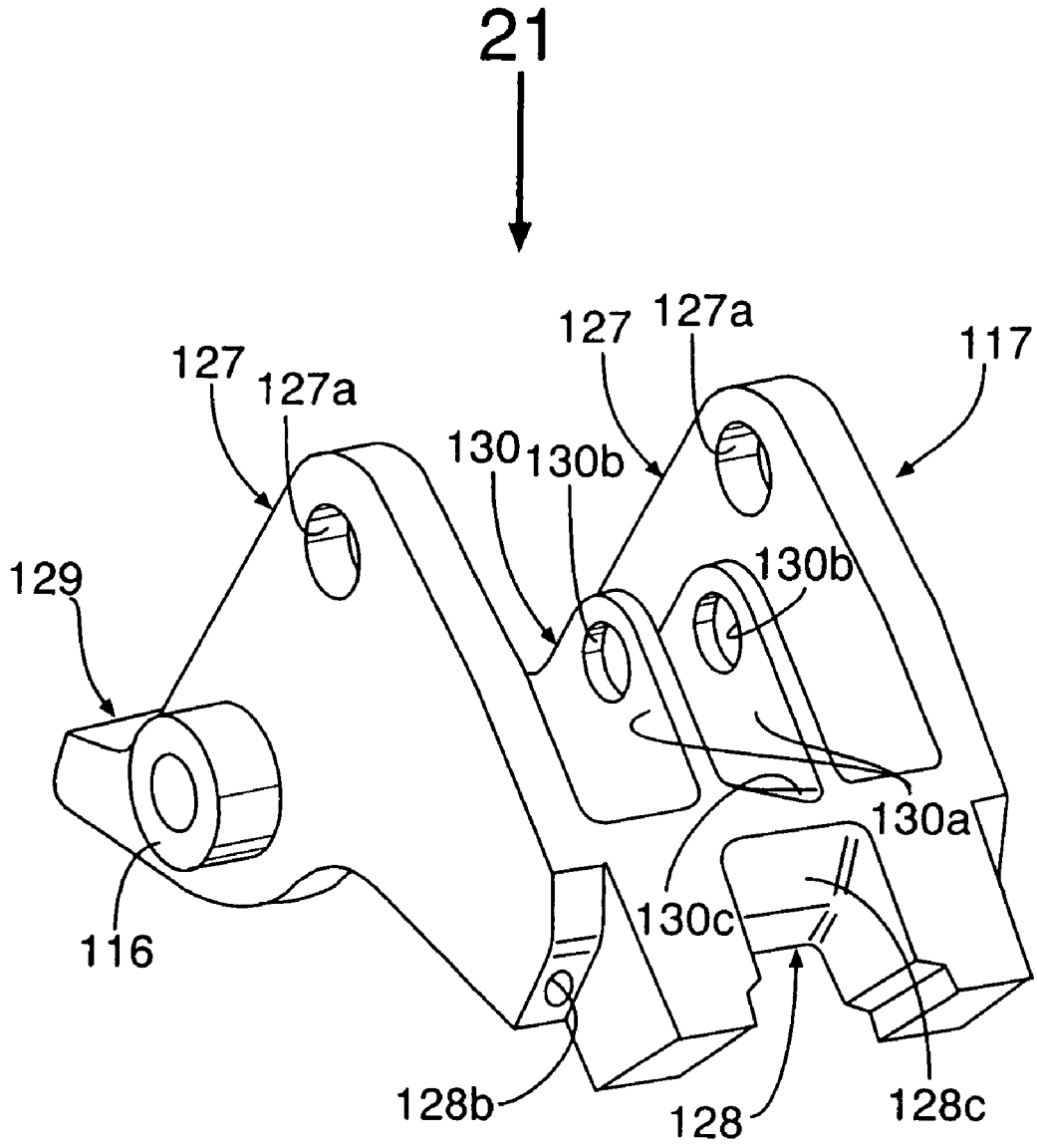
Figure 20:
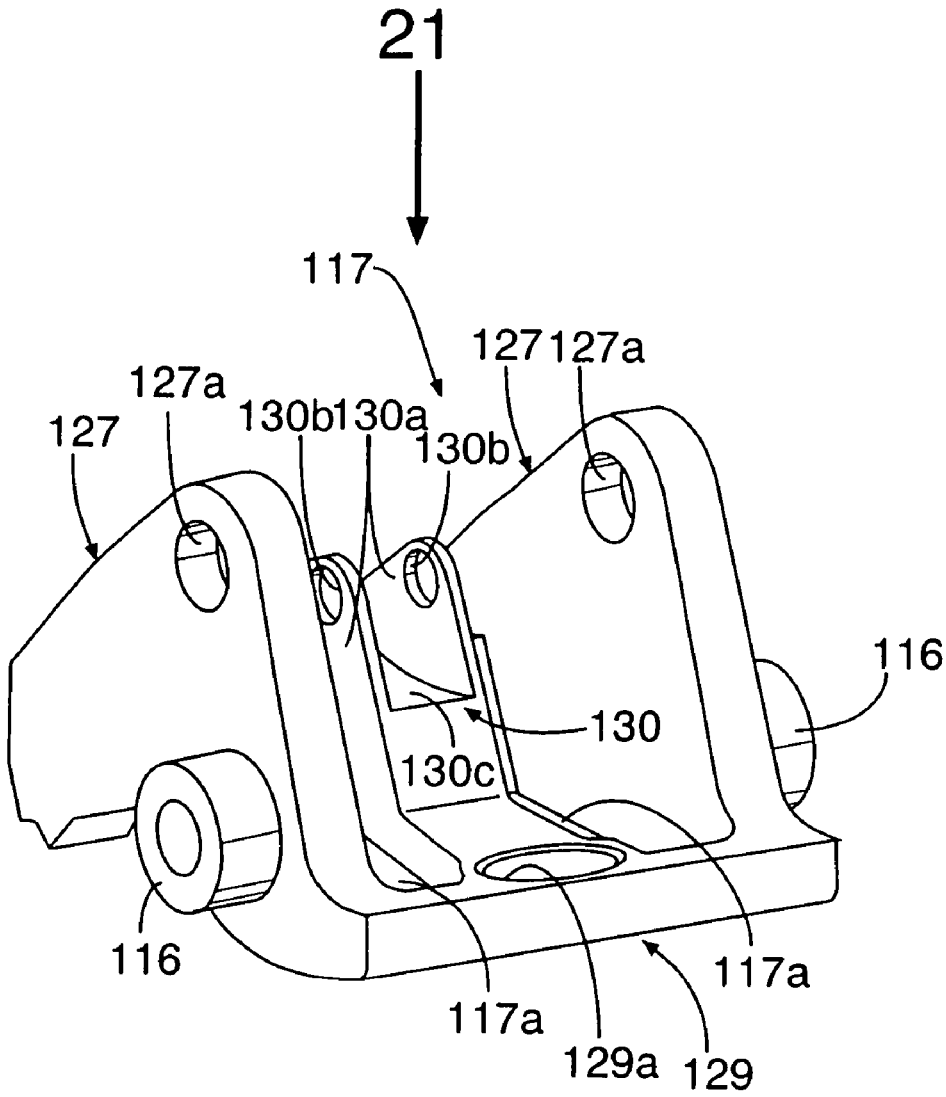
Figure 21:
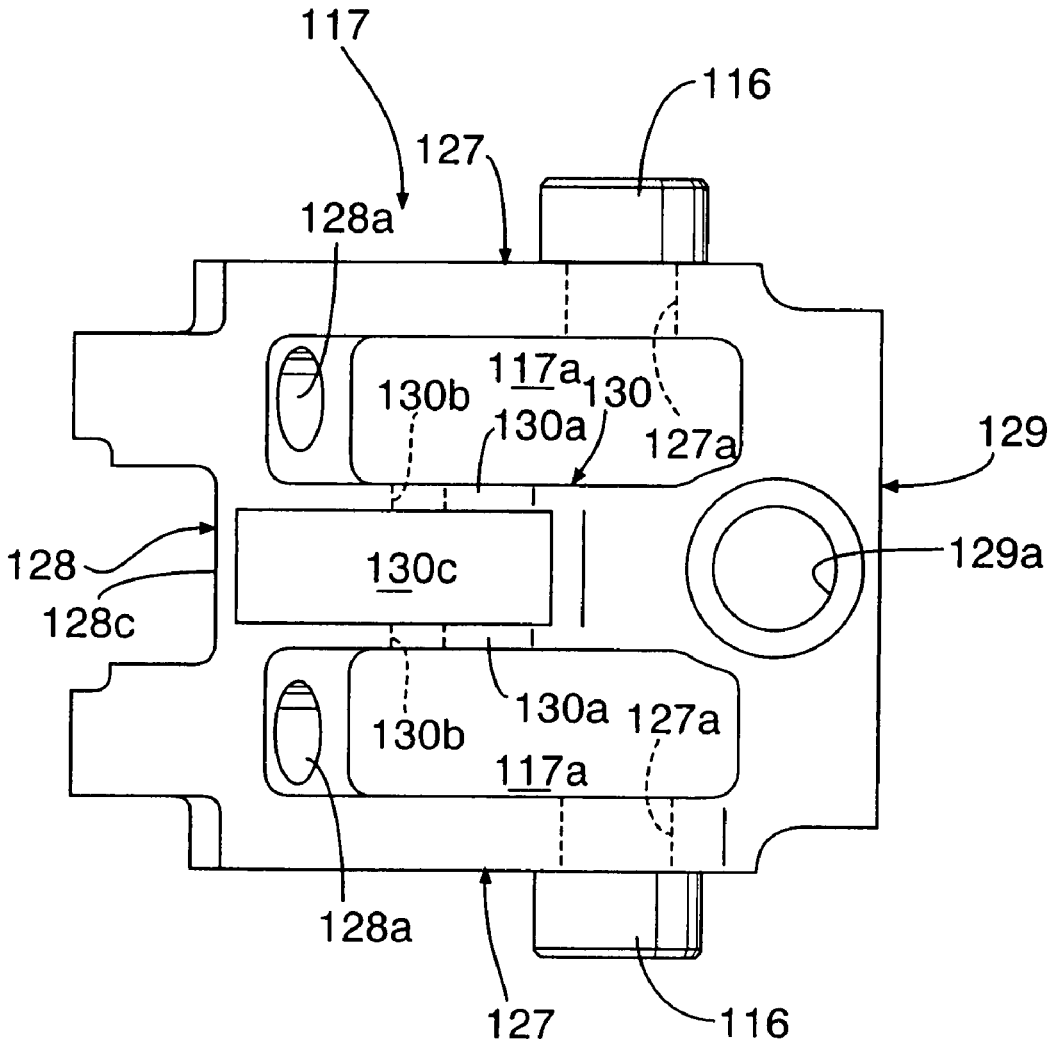

The shape of the control arm 117 will be described in reference to FIGS. 19 to 21.

The control arm 117 comprises a single member including a pair of plate-shaped sidewalls 127, 127 provided with the pair of shaft portions 116, 116. The sidewalls 127, 127 are disposed in parallel with each other with a predetermined distance therebetween. One ends of the sidewalls 127, 127 are connected to each other by a first connecting wall 128 extending in parallel with the shaft portions 116, 116, and the other ends thereof are connected to each other by a second connecting wall 129 extending in parallel with the shaft portions 116, 116. That is, as shown in FIG. 21, the control arm 117 is formed into a shape of a square frame including the pair of sidewalls 127, 127, the first connecting wall 128, and the second connecting wall 129. Thus, the rigidity of the control arm 117 is enhanced by reinforcing effect of the first connecting wall 128 and the second connecting wall 129. Particularly, the second connecting wall 129 is provided at a position in the vicinity of the shaft portions 116, 116 on which a maximum load acts in the control arm 117, so as to effectively contribute to improvement of the rigidity of the control arm 117.

In addition to the shaft portions 116, 116 projectingly provided integrally on the sidewalls 127, 127 of the control arm 117, shaft holes 127*a*, 127*a* are formed in the sidewalls 127, 127 into which the movable support shaft 120 are press-fitted. A bulkhead 130 integrally connects the first and second connecting walls 128 and 129 of the control arm 117. Thus, the rigidity of the control arm 117 is further enhanced by reinforcing effect of the second connecting wall 129.

The pair of sidewalls 127, 127 extend in parallel with the bulkhead 130 to form two rocker-arm receiving holes 117*a*, 117*a* therebetween. A pair of roller support portions 130*a*, 130*a* extend upward from the bulkhead 130 at a position close to the first connecting wall 128. Shaft holes 130*b*, 130*b* are formed in the roller support portions 130*a*, 130*a*. A roller shaft 147, which will be described later, are press-fitted into the shaft holes 130*b*, 130*b*. A roller receiving recess 130*c* is formed between the pair of roller support portions 130*a*, 130*a*. A part of the bottom wall of the roller receiving recess 130*c* is formed by the first connecting wall 128.

A pair of hydraulic-tappet mounting holes 128*a*, 128*a* for mounting therein hydraulic tappets 131, 131, which will be described later, are formed in the first connecting wall 128 so as to be opposed to the rocker-arm receiving holes 117*a*, 117*a*. Oil discharging bores 128*b*, 128*b* communicating with the hydraulic-tappet mounting holes 128*a*, 128*a* are formed in the first connecting wall 128. Oil discharged from the hydraulic tappets 131, 131 drops downward through the oil discharging bores 128*b*, 128*b*.

As apparently shown in FIGS. 13 to 18, the rocker arms 122, 122 are of a type without a rocker shaft. Each rocker arm 122 is rockably supported, at a recess 122*a* formed at its one end, on a spherical surfaced bearing 131*a* formed at a tip end of the hydraulic tappet 131 mounted in the hydraulic-tappet mounting hole 128*a* in the first connecting wall 128, and drives the intake valve 112 at its other end. An abutting member 132 abutting on an upper end of the stem 112*a* of the intake valve 112 is swingably supported at the other end of the rocker arm 122. Thus, a seated state of the intake valve 112 can be adjusted by adjusting the position of the abutting member 132 with an adjusting screw 133 and a lock nut 134.

Rollers 137 are rotatably supported via ball bearings 136 on a roller shaft 135 extending between roller receiving holes 122*b* formed in intermediate portions of the rocker arms 122.

The rocker arms 122, 122 are received and fitted in the rocker-arm receiving holes 117*a*, 117*a* between the pair of the sidewalls 127, 127 and the bulkhead 130 of the control arm 117. The rocker arm 122 having no rocker shaft merely abuts at one end against the hydraulic tappet 131, and abuts at the other end against the stem 112*a* of the intake valve 112, and the roller 137 at the central portion is supported on the subsidiary cam 121 merely in an abutting manner. Thus, the rocker arm 122 has an unstable attitude and is likely to fall, leading to a concern of difficulty in assembling thereof. However, in this embodiment, each rocker arm 122 is sandwiched from opposite sides by the sidewall 127 and the bulkhead 130 so as to prevent the falling, thereby facilitating the assembling of the rocker arm 122.

A support shaft 138 is press-fitted into the shaft holes 127*a*, 127*a* formed in the pair of sidewalls 127, 127 of the control arm 117. The subsidiary cam 121 is rockably supported on the support shaft 138. A roller 141 is supported via a roller shaft 139 and a ball bearing 140 on a first arm 121*a* protruding from an axially central portion of the subsidiary cam 121. The roller 141 abuts against the valve-operating cam 114 provided on the cam shaft 115. Cam faces 121*c*, 121*c* are formed on a pair of second arms 121*b*, 121*b* protruding from axially opposite ends of the subsidiary cam 121. The rollers 137, 137 of the rocker arms 122, 122 abut against the cam faces 121*c*, 121*c*.

An urging means 142 for generating an urging force to cause the roller 141 of the subsidiary cam 121 to abut against the valve-operating cam 114 is mounted in an urging-means mounting hole 129*a* formed in the second connecting wall 129 of the control arm 117. The urging means 142 comprises a guide tube 143, a pressing member 144, an abutting portion 145 and a coil spring 146. The guide tube 143 is press-fitted into the urging-means mounting hole 129*a* of the second connecting wall 129. The pressing member 144 is slidably fitted into the guide tube 143. The abutting portion 145 is provided on an upper end of the pressing member 144, and abuts against a lower face of the first arm 121*a*. The coil spring 146 is provided under compression between the guide tube 143 and the abutting portion 145, and urges the pressing member 145 in the direction to protrude.

In the control arm 117, a high rigidity is imparted to a portion where the second connecting wall 129 and the bulkhead 130 are connected to each other. Because the urging means 142 is supported at this portion, the urging means 142 can minimize bending deformation of the control arm 117 due to a reaction force by the urging force acting on the subsidiary cam 121. Further, the urging means 142, the roller 141 of the subsidiary cam 121 and the valve-operating cam 114 are arranged on the same plane perpendicular to a line of cylinder alignment (on a paper surface of FIG. 15). With this arrangement, a load from the valve-operating cam 114 and a load from the urging means 142 do not act in the direction to fall the control arm 117 (the direction to incline with respect to the paper surface of FIG. 15), whereby the bending deformation of the control arm 117 is minimized to enhance accuracy in controlling the valve lift of the intake valves 112, 112.

Figure 14:
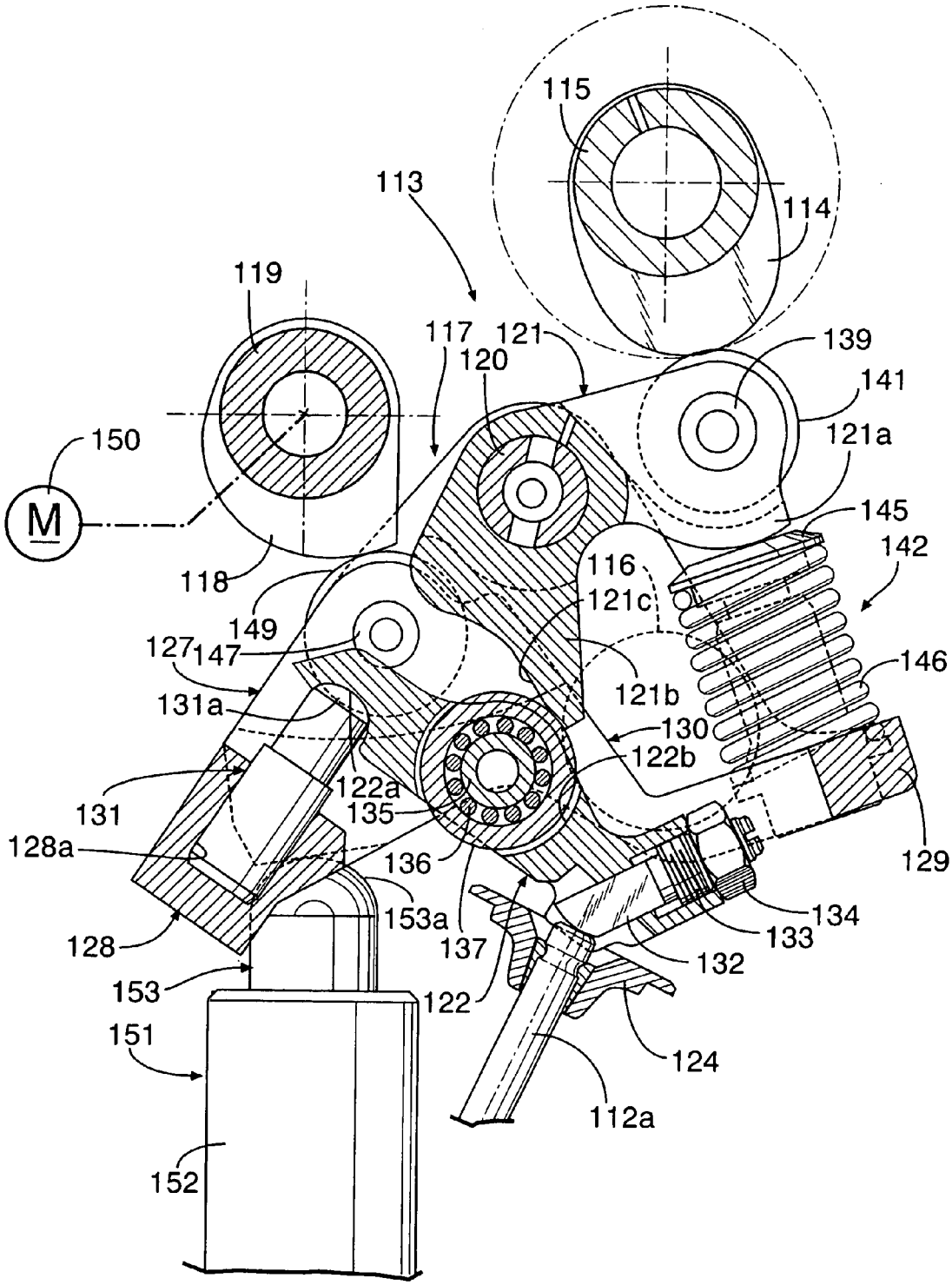
Figure 15:
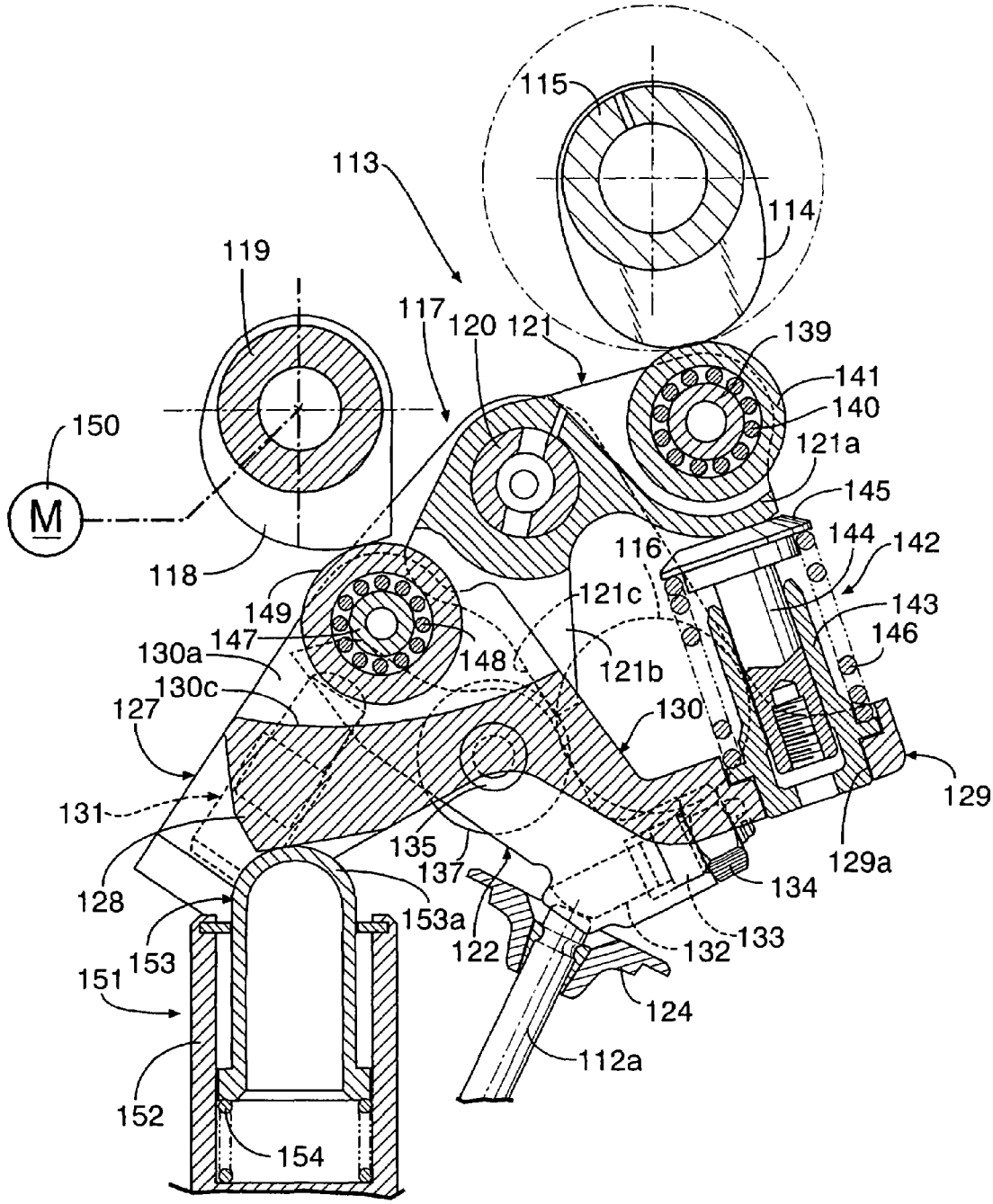
Figure 16:
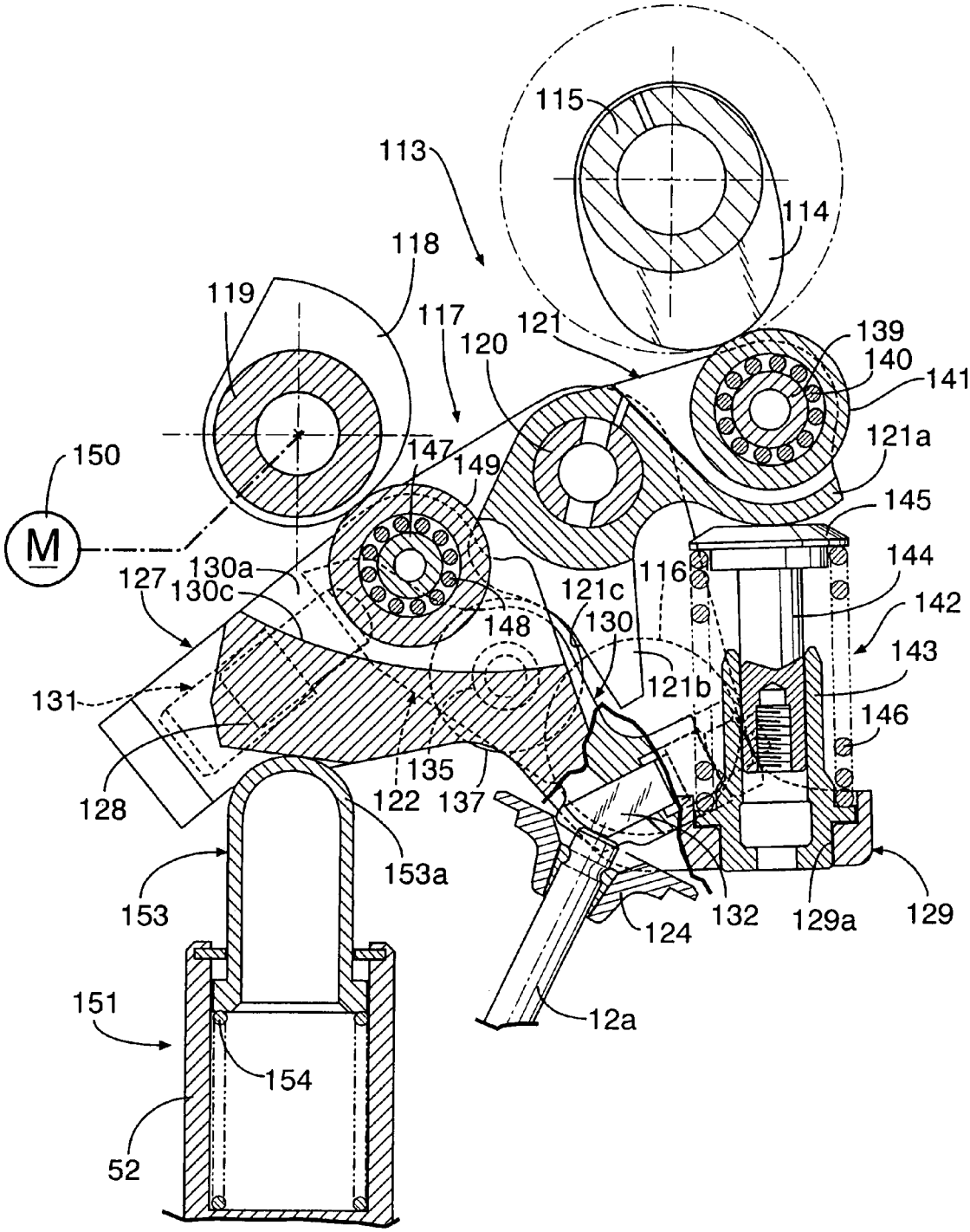
Figure 17:
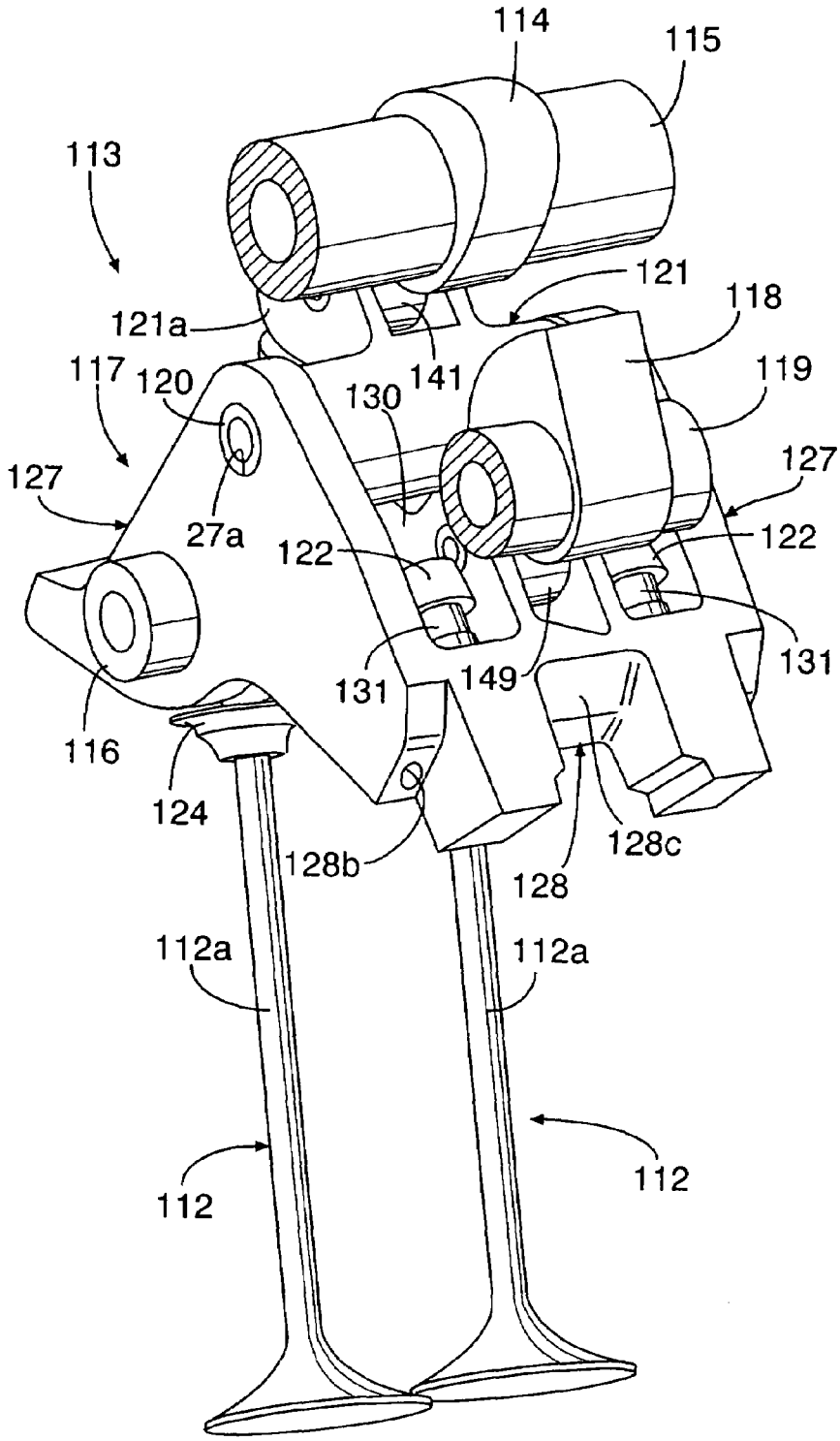
Figure 18:
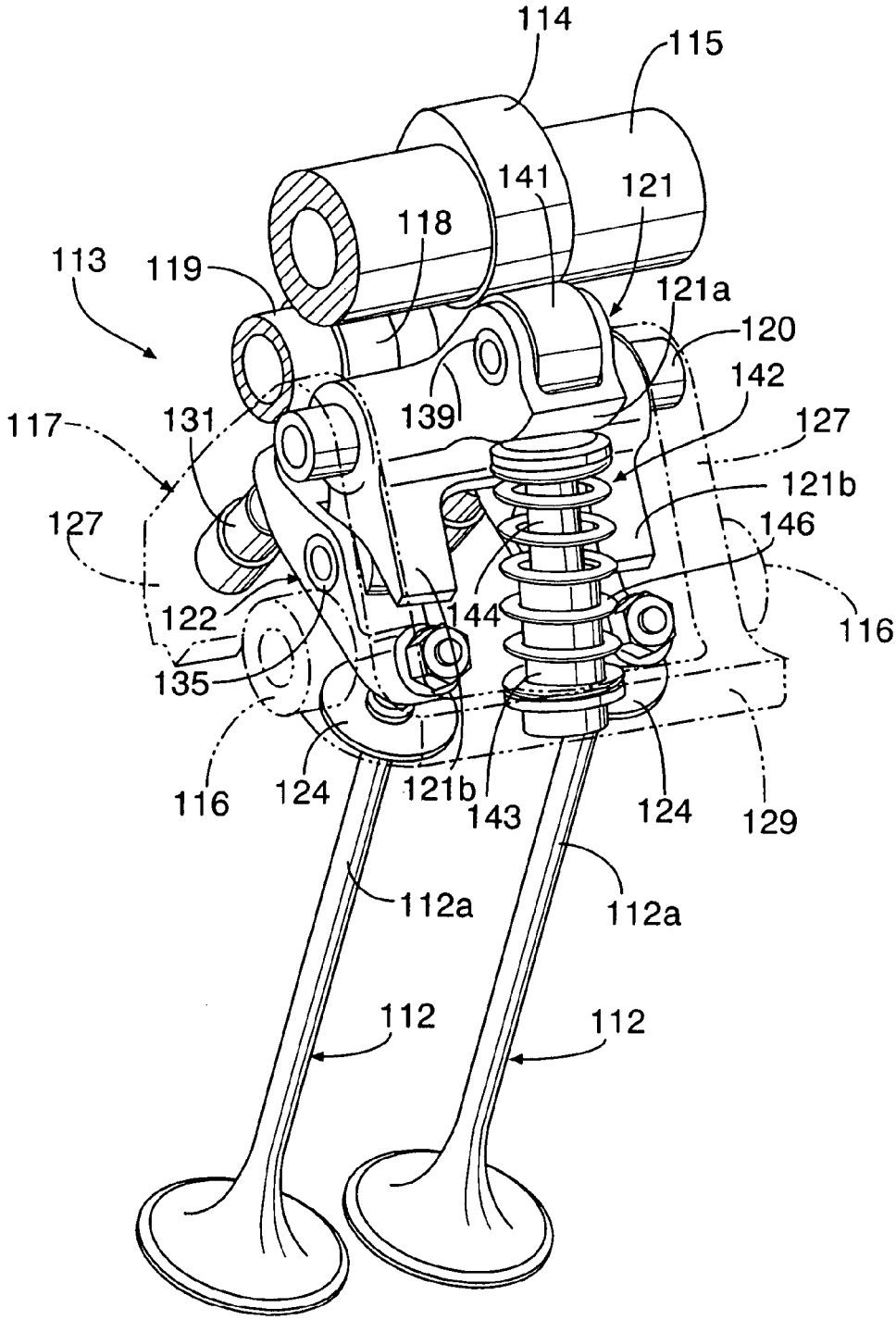

A roller 149 is rotatably supported via a ball bearing 148 on the roller shaft 147 press-fitted into the shaft holes 130*b*, 130*b* of the roller support portions 130*a*, 130*a*, and is received in a roller receiving recess 130*c* formed in a central portion of the bulkhead 130 of the control arm 117. The control cam 118 with a cam face comprising an involute curvature is provided on the control shaft 119 which is reciprocatingly turned by an actuator comprising an electric motor so that the control cam 118 pushes the roller 149 to cause the control arm 117 to swing about the shaft portions 116, 116. Referring to FIGS. 14 to 16, when the control shaft 119 rotates clockwise, the control arm 117 swings counterclockwise about the shaft portions 116, 116; and when the control shaft 119 swings counterclockwise, the control arm 117 swings clockwise about the shaft portions 116, 116.

An urging means 151 is provided in the cylinder head 111 so as to urge the control arm 117 clockwise to cause the roller 149 to abut on the control cam 118. The urging means 151 causes a pressing member 153 to be slidably fitted into a guide tube 152 press-fitted in the cylinder head 111, and urges the pressing member 153 in the direction to protrude out of the guide tube 152 by a resilient force of a coil spring 154. The pressing member 153 has a spherical portion 153*a* which abuts against a central potion of a lower face of the first connecting wall 128 of the control arm 117.

As described above, because the roller 149 is supported using the bulkhead 130 of the control arm 117, a dedicated member for supporting the roller 149 is not required, thereby reducing the number of components and simplifying the structure. Also, particularly because the roller 149 is received in the roller receiving recess 130*c* formed in the bulkhead 130 of the control arm 117, the reduction in the rigidity of the control arm 117 due to the arrangement of the roller receiving recess 130*c* can be minimized by reinforcing effect of the first connecting wall 128 constituting the bottom wall of the roller receiving recess 130*c*, while securing a space for mounting the roller 149 using the space of the roller receiving recess 130*c*.

Further, because the urging means 151 urges the control arm 117 to cause the roller 149 to abut on the control cam 118, the roller 149 is prevented from floating above the control cam 118, thereby stabilizing the behavior of the control arm 117 to enhance the accuracy in controlling the valve lift of the intake valves 112, 112.

Furthermore, because the position where the first connecting wall 128 and the bulkhead 130 of the control arm 117 are connected to each other, specifically, the position between the pair of the hydraulic tappets 131, 131 supported on the first connecting wall 128, that is, the portion having a high rigidity in the control arm 117 is pressed by the urging means 151, the bending of the control arm 117 is prevented by the pressing force of the urging means 151, thereby further enhancing the accuracy in controlling the valve lift of the intake valves 112, 112.

Particularly because the control cam 118, the roller 149 of the control arm 117 on which the control cam 118 abuts, the urging means 151 urging the control arm 117 in the direction to cause the roller 149 to abut on the control cam 118 are arranged on the same plane perpendicular to the line of cylinder alignment (on a paper surface of FIG. 15), a load from the control cam 118 and a load from the urging means 151 do not act in the direction to fall the control arm 117 (the direction to incline with respect to the paper surface of FIG. 15), whereby the bending deformation of the control arm 117 is minimized to enhance the accuracy in controlling the valve lift of the intake valves 112, 112.

Moreover, because the urging means 151 is disposed below the hydraulic tappets 131, 131 in the direction of the cylinder axes, the oil discharged from the tappets 131, 131 drops downward through the oil discharging bores 128*b*, 128*b* of the first connecting wall 128, thereby effectively lubricating the urging means 151.

As apparently shown in FIG. 12, an ignition-plug housing tube 156 for guiding attachment/detachment of an ignition plug 155 is press-fitted in the cylinder head 111, and also the guide tube 152 integral with the ignition-plug housing tube 156 is press-fitted in the cylinder head 111. In this way, the guide tube 152 is formed integrally with the ignition-plug housing tube 156, thereby enhancing the rigidity of the urging means 151 to further stabilize the behavior of the control arm 117.

As apparently shown in FIGS. 12 and 13, the ignition-plug housing tube 156 is disposed using the recess 128*c* formed in the first connecting wall 128 of the control arm 117, that is, using a space between the portions where the pair of the hydraulic tappets 131, 131 are supported in the first connecting wall 128. With this arrangement, the control arm 117 and the ignition-plug housing tube 156 are disposed as close to each other as possible while avoiding interference therebetween, thereby downsizing the lift-variable valve-operating mechanism 113.

Therefore, when the control arm 117 is situated at the position shown in FIGS. 14 and 15 by the control cam 118, in other words, when a highest lift portion of the control cam 118 abuts on the roller 149, tip end portions (on a side far from the movable support shaft 120) of the cam faces 121*c*, 121*c* of the subsidiary cam 121 which rotates about the axis of the movable support shaft 120 abut on the rollers 137 of the rocker arms 122, 122, thereby increasing the swing angle of the rocker arms 122, 122 so that the valve lift of the intake valves 112, 122 is maximized.

On the other hand, when the control arm 117 is situated at the position shown in FIG. 16 by the control cam 118, in other words, when a lowest lift portion of the control cam 118 abuts on the roller 149, base end portions (on a side near the movable support shaft 120) of the cam faces 121*c*, 121*c* of the subsidiary cam 121 which rotates about the axis of the movable support shaft 120 abut on the rollers 137 of the rocker arms 122, 122, thereby decreasing the swing angle of the rocker arms 122, 122 so that the valve lift of the intake valves 112, 122 is minimized (to zero).

As described above, the swing of the control arm 117 about the shaft portions 116, 116 changes the valve lift of the intake valves 112, 112, and the driving of the control arm 117 changes the timing when the valve-operating cams 114, 114 contact the rollers 141, 141, and thus changes the opening/closing timing of the intake valves 112, 112.

Although the embodiments of the present invention have been described in detail, the present invention is not limited to the above-described embodiments, and various modifications in design can be made without departing from the subject matter of the invention defined in the claims.

For example, the valve-operating device for the intake valves 16 has been described in each of the embodiments, but the present invention is also applicable to a valve-operating device for exhaust valves which are engine valves.

Also, in the fourth embodiment, instead of the roller 149, a slipper may constitute the cam follower of the control arm 117 on which the control 118 abuts.

What is claimed is:

1. A lift-variable valve-operating system for an internal combustion engine, comprising:

a control arm (117) which is swingably supported in an engine body (111) through support shaft portions (116) provided on a pair of sidewalls (127), respectively;

a plurality of rocker arms (122) which are swingably supported on spherical surfaced bearings (131*a*) between the pair of sidewalls (127) of the control arm (117) and which abut against engine valves (112); and a subsidiary cam (121) which is swingably supported between the pair of sidewalls (127) and which is driven by a valve-operating cam (114) to drive the rocker arm (122), the control arm (117) being rotated about the support shaft portions (116) by an actuator (150) to change at least a valve lift of the engine valves (112), the control arm (117) including a bulkhead (130) between the adjacent rocker arms (122) so as to prevent falling of the rocker arms (122).

2. A lift-variable valve-operating system for an internal combustion engine according to claim 1, wherein the control arm (117) includes a connecting wall (129) which connects the pair of sidewalls (127) to each other at positions of the pair of support shaft portions (116); and the bulkhead (130) is connected to the connecting wall (129).

3. A lift-variable valve-operating system for an internal combustion engine according to claim 1, wherein the bulkhead (130) is provided with an abutment portion (149) against which a control member (118) for swinging the control arm (117) abuts.

4. A lift-variable valve-operating system for an internal combustion engine according to claim 2, wherein the bulkhead (130) is provided with an abutment portion (149) against which a control member (118) for swinging the control arm (117) abuts.

5. A lift-variable valve-operating system for an internal combustion engine according to any of claim 1, wherein the control arm (117) includes an end wall (128) connecting the pair of sidewalls (127) to each other at positions of swing support portions (131) of the rocker arms (122); and the bulkhead (130) is connected to the end wall (128).

6. A lift-variable valve-operating system for an internal combustion engine according to claim 2, wherein the control arm (117) includes an end wall (128) connecting the pair of sidewalls (127) to each other at positions of swing support portions (131) of the rocker arms (122); and the bulkhead (130) is connected to the end wall (128).

7. A lift-variable valve-operating system for an internal combustion engine according to claim 3, wherein the control arm (117) includes an end wall (128) connecting the pair of sidewalls (127) to each other at positions of swing support portions (131) of the rocker arms (122); and the bulkhead (130) is connected to the end wall (128).

8. A lift-variable valve-operating system for an internal combustion engine according to claim 4, wherein the control arm (117) includes an end wall (128) connecting the pair of sidewalls (127) to each other at positions of swing support portions (131) of the rocker arms (122); and the bulkhead (130) is connected to the end wall (128).

9. A lift-variable valve-operating system for an internal combustion engine according to claim 1, wherein the bulkhead (130) is connected to an end wall (128) which connects the pair of sidewalls (127) of the control arm (117) to each other at positions of swing support portions (131) of the rocker arms (122); the bulkhead (130) is provided with a roller receiving recess (130*c*) for housing a roller (149) against which a control member (118) for swinging the control arm (117) abuts; and the end wall (128) forms at least a part of the roller receiving recess (130*c*).

* * * * *